US007059298B2

(12) United States Patent
Ozaki et al.

(10) Patent No.: US 7,059,298 B2
(45) Date of Patent: Jun. 13, 2006

(54) EVAPORATIVE FUEL PROCESSING DEVICE FOR AN INTERNAL COMBUSTION ENGINE

(75) Inventors: Toshihiro Ozaki, Susono (JP); Mamoru Yoshioka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/153,733

(22) Filed: Jun. 16, 2005

(65) Prior Publication Data

US 2005/0284445 A1 Dec. 29, 2005

(30) Foreign Application Priority Data

Jun. 24, 2004 (JP) ..... 2004-186918

(51) Int. Cl.
*F02D 41/14* (2006.01)
*F02D 41/02* (2006.01)
*F02M 25/08* (2006.01)

(52) U.S. Cl. ..... 123/325; 123/520; 123/675; 123/698

(58) Field of Classification Search ..... 123/325, 123/493, 520, 674, 675, 698
See application file for complete search history.

(56) References Cited

U.S. PATENT DOCUMENTS

| | | | | |
|---|---|---|---|---|
| 5,546,917 | A | 8/1996 | Osanai et al. | 123/674 |
| 5,944,003 | A * | 8/1999 | Osanai | 123/698 |
| 6,397,829 | B1 * | 6/2002 | Toyoda | 123/674 |
| 2003/0005916 | A1 * | 1/2003 | Osanai | 123/698 |

FOREIGN PATENT DOCUMENTS

| | | |
|---|---|---|
| JP | A 06-026409 | 2/1994 |
| JP | A 07-269399 | 10/1995 |
| JP | A 08-014083 | 1/1996 |

* cited by examiner

*Primary Examiner*—T. M. Argenbright
(74) *Attorney, Agent, or Firm*—Oliff & Berridge, PLC.

(57) ABSTRACT

The present invention judges whether an internal combustion engine is operated by a special operation method in which a fuel cut is performed more frequently than predefined depending on the operation of an accelerator pedal. The present invention provides a shorter purge resumption period subsequently to recovery from a fuel cut when it is judged that the internal combustion engine is operated by the special operation method than when it is judged that the internal combustion engine is not operated by the special operation method. The purge resumption period is a period during which a purge gas flow rate is lower than during a steady operation.

9 Claims, 14 Drawing Sheets

When flag (A) = OFF

When flag (A) = ON

EVAPORATIVE FUEL PROCESSING DEVICE FOR AN INTERNAL COMBUSTION ENGINE

BACKGROUND OF THE INVENTION

1. Field of the Invention

The present invention relates to an evaporative fuel processing device for an internal combustion engine, and more particularly to an evaporative fuel processing device for an internal combustion engine that stops the supply of a purge gas to the internal combustion engine in accordance with a fuel cut.

2. Background Art

The internal combustion engine for a vehicle is provided with a canister for adsorbing and storing evaporative fuel that is generated within a fuel tank. The evaporative fuel stored by the canister is purged out of the canister by using a negative pressure in an intake path during an internal combustion engine operation. The purged evaporative fuel is diluted with air that is introduced from an atmospheric air hole in the canister, supplied to a combustion chamber as purge gas, and subjected to a combustion process.

The purge gas supply is controlled by a purge valve that is positioned between the canister and intake path. When the purge valve operates, causing the negative pressure in the intake path to work on the canister, the evaporative fuel purge from the canister is promoted. Consequently, the adsorption capacity of the canister is restored to normal. The adsorption capacity of the canister is limited. When the amount of the introduced evaporative fuel is beyond the adsorption capacity, the evaporative fuel overflows the canister. If the evaporative fuel overflows, the emission deteriorates. Therefore, the rate of purge gas flow into the combustion chamber should be set as high as possible to prevent the evaporative fuel adsorption amount from exceeding the canister capacity. Meanwhile, the purge gas containing evaporative fuel may cause disturbance by varying the air-fuel ratio. It is therefore necessary that the purge gas flow rate be set so as not to adversely affect drivability.

Various purge control techniques were proposed. A prior art disclosed, for instance, in Japanese Patent Laid-open No. Hei 6-26409 determines a learning correction value for the amount of fuel supply from a feedback coefficient for air-fuel ratio feedback control and increases the purge gas flow rate setting with an increase in the frequency with which the learning correction value is updated, thereby making it possible to purge a large amount of evaporative fuel while minimizing the air-fuel ratio discrepancy.

The internal combustion engine performs a fuel cut to shut off the entire fuel supply, including the supply of purge gas, during the time interval between the instant at which the upper-limit engine speed is reached and the instant at which the engine speed lowers to an appropriate level or during the time interval between the instant at which the accelerator pedal is released and the instant at which accelerator pedal is depressed. When a fuel cut is performed, fuel injection comes to a stop so that air-fuel ratio feedback control is temporarily stopped. Thus, air-fuel ratio discrepancy is likely to occur after recovery from the fuel cut. Therefore, when the purge gas supply is to be resumed upon recovery from the fuel cut, it is necessary to control the purge gas flow rate in such a manner that air-fuel ratio discrepancy does not adversely affect drivability.

When the evaporative fuel is no longer purged due to a fuel cut, the above prior art resets the learning correction value update count. The purge gas flow rate then reverts to a basic value so that the purge gas flow rate setting is lower than when the fuel supply amount is learned to a considerable extent. However, if the purge gas flow rate decreases upon each fuel cut in a situation where a fuel cut is performed frequently, the evaporative fuel may not properly be purged out of the canister so that the evaporative fuel eventually overflows the canister.

SUMMARY OF THE INVENTION

The present invention has been made to solve the above problems. It is an object of the present invention to provide an evaporative fuel processing device for an internal combustion engine that is capable of properly performing an evaporative fuel purge without impairing drivability in a situation where a fuel cut is frequently performed.

In accordance with one aspect of the present invention, an evaporative fuel processing device for an internal combustion engine comprises a purge unit for supplying a purge gas, which contains evaporative fuel generated within a fuel tank, to an internal combustion engine's intake path; an air-fuel ratio feedback control unit for learning purge gas density from the difference between exhaust air-fuel ratio and target air-fuel ratio, which prevails during an operation of the purge unit, and controlling the amount of fuel injection in accordance with the learned purge gas density; a purge control unit for controlling the operation of the purge unit so that a purge gas flow rate matches the operating state of the internal combustion engine, stopping the operation of the purge unit when a fuel cut is performed, and providing a lower purge gas flow rate setting during a predetermined purge resumption period subsequent to recovery from a fuel cut than during a steady operation period; and a judgment unit for judging whether the internal combustion engine is operated by a special operation method in which a fuel cut is performed more frequently than predefined depending on the operation of an accelerator pedal. The purge control unit provides a shorter purge resumption period subsequently to recovery from a fuel cut when the judgment unit judges that the internal combustion engine is operated by the special operation method than when the judgment unit judges that the internal combustion engine is not operated by the special operation method.

In accordance with another aspect of the present invention, an evaporative fuel processing device for an internal combustion engine comprises a purge unit for supplying a purge gas, which contains evaporative fuel generated within a fuel tank, to an internal combustion engine's intake path; an air-fuel ratio feedback control unit for learning purge gas density from the difference between exhaust air-fuel ratio and target air-fuel ratio, which prevails during an operation of the purge unit, and controlling the amount of fuel injection in accordance with the learned purge gas density; a purge control unit for controlling the operation of the purge unit so that a purge gas flow rate matches the operating state of the internal combustion engine, stopping the operation of the purge unit when a fuel cut is performed, and providing a lower purge gas flow rate setting during a predetermined purge resumption period subsequent to recovery from a fuel cut than during a steady operation period; and a judgment unit for judging whether the internal combustion engine is operated by a special operation method in which a fuel cut is performed more frequently than predefined depending on the operation of an accelerator pedal. The purge control unit provides a higher purge gas flow rate setting for the purge resumption period subsequent to recovery from a fuel cut when the judgment unit judges that the internal combustion engine is operated by the special operation method than when the judgment unit judges that the internal combustion engine is not operated by the special operation method.

Other objects and further features of the present invention will be apparent from the following detailed description when read in conjunction with the accompanying drawings.

DESCRIPTION OF THE PREFERRED EMBODIMENT

First Embodiment

A first embodiment of the present invention will now be described with reference to FIGS. 1 to 8.

[Description of Engine System Configuration]

Figure 1:
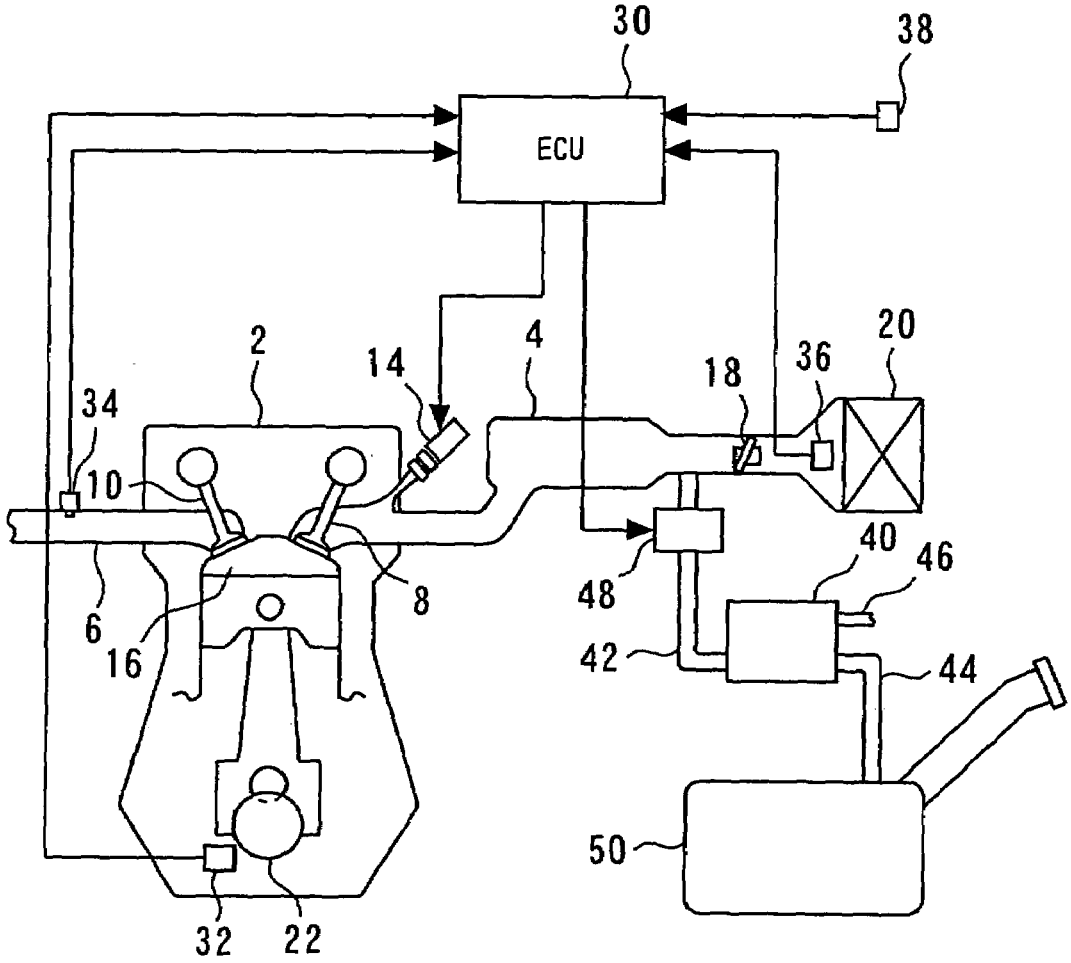
FIG. 1 is a schematic diagram illustrating the configuration of an engine system to which the first embodiment of an evaporative fuel processing device for an internal combustion engine according to the present invention is applied.

FIG. 1 is a schematic diagram illustrating the configuration of an engine system to which the first embodiment of an evaporative fuel processing device for an internal combustion engine according to the present invention is applied. A combustion chamber 16 of an internal combustion engine 2 according to the present embodiment is connected to an intake path 4 and an exhaust path 6. The joint between the combustion chamber 16 and intake path 4 is provided with an intake valve 8, which controls the communication between the combustion chamber 16 and intake path 4. The joint between the combustion chamber 16 and exhaust path 6 is provided with an exhaust valve 10, which controls the communication between the combustion chamber 16 and exhaust path 6. The intake path 4 is provided with an air cleaner 20. An electronic control type throttle valve 18 is positioned downstream of the air cleaner 20 to adjust the amount of fresh air that flows into the combustion chamber 16. A fuel injection valve 14 is installed near the intake valve 8 in the intake path 4 to supply fuel to the combustion chamber 16.

The fuel to be injected from the fuel injection valve 14 is supplied from a fuel tank 50 via a fuel path (not shown). A vapor path 44 is connected to the fuel tank 50 in order to extract evaporative fuel that is generated within the fuel tank 50. A canister 40 is connected to one end of the vapor path 44. The interior of the canister 40 is filled with activated carbon, which adsorbs evaporative fuel. Therefore, the evaporative fuel generated within the fuel tank 50 passes through the vapor path 44, reaches the canister 40, and becomes adsorbed to the inside of the canister 40. The canister 40 is connected to an atmospheric air supply path 46 and to a purge path 42. The purge path 42 communicates with the intake path 4 at a location downstream of the throttle valve 18. The purge path 42 is provided with a purge control valve 48, which controls the flow rate of a gas that flows within the purge path 42. The purge control valve 48 is a control valve that provides an arbitrary valve opening when subjected to duty cycle control.

The internal combustion engine 2 includes an ECU (Electronic Control Unit) 30, which serves as an internal combustion engine control device. In accordance with operation data concerning the internal combustion engine 2, which is detected by a plurality of sensors, the ECU 30 exercises overall control over various devices relevant to the operation of the internal combustion engine 2. The input side of the ECU 30 is connected to a rotation speed sensor 32, an A/F sensor 34, an air flow meter 36, and an accelerator position sensor 38. The rotation speed sensor 32 is positioned near a crankshaft 22 to output a signal according to the engine speed. The A/F sensor 34 is installed in the exhaust path 6 to output a signal according to the exhaust gas air-fuel ratio (exhaust air-fuel ratio). The air flow meter 36 is positioned downstream of and next to the air cleaner 20 to output a signal according to the intake air flow rate. The accelerator position sensor 32 is mounted on the accelerator pedal (not shown) to output a signal according to the accelerator position. The output side of the ECU 30 is connected to the fuel injection valve 14 and purge control valve 48. The ECU 30 receives operation data from sensors 32, 34, 36, and 38 and supplies drive signals to devices 14 and 48. Although a plurality of other sensors and devices are connected to the ECU 30 in addition to sensors 32, 34, 36, and 38 and devices 14 and 48, they are not described herein.

[Overview of Purge Control]

The ECU 30 exercises purge control over the internal combustion engine 2 to remove evaporative fuel that is adsorbed by the canister 40. This purge control is exercised by subjecting the purge control valve 48 to an appropriate duty drive when predefined purge execution conditions are established during an internal combustion engine operation. The purge execution conditions are established when the operation status of the internal combustion engine 2 is in a predefined zone. The operation status of the internal combustion engine 2 can be determined from the engine speed and intake air flow rate.

While purge control is exercised, the drive duty ratio of the purge control valve 48 is controlled so that the purge ratio epgr coincides with a target purge ratio. The purge ratio epgr is the ratio of the purge gas flow rate to the intake air flow rate. The target purge ratio is a target value that is to be attained by means of control. The target purge ratio is determined by searching a map that is prepared to define internal combustion engine operation status as search conditions. The purge gas flow rate is calculated from intake pressure and the drive duty ratio of the purge control valve 48. The intake pressure is estimated, for instance, from the intake air flow rate.

When the purge control valve 48 is subjected to duty drive, the negative pressure in the intake path 4 of the internal combustion engine 2 is introduced into the canister 40. Consequently, the evaporative fuel in the canister 40 is discharged into the purge path 42 as purge gas together with fresh air that is taken in from the atmospheric air supply path 46. The discharged purge gas is supplied to the intake path 6 via the purge path 42 and burned in the combustion chamber 16.

[Overview of Air-Fuel Ratio Feedback Control]

The ECU 30 also exercises air-fuel ratio feedback control over the internal combustion engine 2 to ensure that the air-fuel ratio of an air-fuel mixture in the combustion chamber 16 coincides with a desired target air-fuel ratio. Air-fuel ratio feedback control is exercised during an internal combustion engine operation to regulate the amount of fuel injection from the fuel injection valve 14 so that the exhaust air-fuel ratio detected by the A/F sensor 34 agrees with a target air-fuel ratio. When the purge control valve 48 operates within the system according to the present embodiment, the evaporative fuel contained in the purge gas is supplied to the combustion chamber 16 in addition to the fuel fed from the fuel injection valve 14. It is therefore necessary to control the fuel injection amount while considering air-fuel ratio changes that may be caused by the supply of the purge gas.

The amount of fuel injection from the fuel injection valve 14 is determined by fuel injection time tau, which is the time during which the fuel injection valve 14 is open. The fuel injection time tau is calculated by Equation (1) below:

$$tau=tp\times(fw+faf+kg-fpg) \quad (1)$$

In Equation (1) above, the symbol tp denotes basic fuel injection time, which is calculated by multiplying the ratio between the engine speed Ne and intake air flow rate Ga (Ga/N3) by a predetermined injection coefficient. The symbols fw, faf, kg, and fpg in Equation (1) above represent correction coefficients. The symbol fw denotes a water temperature correction coefficient, which is set in accordance with the cooling water temperature of the internal combustion engine 2. The cooling water temperature is detected by a water temperature sensor (not shown) that is mounted on a water jacket (not shown) for the internal combustion engine 2.

The symbol faf in Equation (1) above is an air-fuel ratio correction coefficient. The air-fuel ratio correction coefficient faf is decremented in small steps for updating purposes while the output from the A/F sensor 32 indicates that the exhaust air-fuel ratio is richer than the target air-fuel ratio. Consequently, the fuel injection time tau decreases little by little, and the exhaust air-fuel ratio detected by the A/F sensor 32 becomes leaner than the target air-fuel ratio before long. When the exhaust air-fuel ratio is no longer rich and is leaner than the target air-fuel ratio, the air-fuel ratio correction coefficient faf greatly increases. The air-fuel ratio correction coefficient faf is then incremented in small steps for updating purposes until the exhaust air-fuel ratio becomes richer than the target air-fuel ratio. Consequently, the fuel injection time tau increases little by little, and the exhaust air-fuel ratio is no longer lean and is richer than the target air-fuel ratio. When the exhaust air-fuel ratio is richer than the target air-fuel ratio, the air-fuel ratio correction coefficient faf greatly decreases. Subsequently, the update process described above is repeatedly performed to ensure that the exhaust air-fuel ratio is close to the target air-fuel ratio.

To ensure that the air-fuel ratio is accurately rendered close to the target air-fuel ratio, it is preferred that the air-fuel ratio correction coefficient faf increase/decrease on either side of a reference value (e.g., 1 or 0). Such a situation occurs when the basic fuel injection time tp virtually corresponds to the target air-fuel ratio. However, the internal combustion engine 2 varies from one unit to another and changes with time. Therefore, there is a certain discrepancy between the basic fuel injection time tp and target air-fuel ratio. The symbol kg in Equation (1) represents an air-fuel ratio learning coefficient that is set to absorb an air-fuel ratio discrepancy, which arises because, for instance, the internal combustion engine 2 varies from one unit to another. The air-fuel ratio learning coefficient kg is expressed by Equation (2) below:

$$kg=kg+tfafav \quad (2)$$

The symbol kg on the left side of Equation (2) above is an updated air-fuel ratio learning coefficient. The symbol kg on the right side of Equation (2) above is an unupdated air-fuel ratio learning coefficient. The symbol tfafav is an updating value that is set in accordance with the deviation between a smoothed value fafav of the air-fuel ratio correction coefficient faf and the reference value of the air-fuel ratio correction coefficient faf. As indicated in Equation (2) above, the ECU 30 calculates the updating value tfafav for each predetermined crank angle, adds up the calculated values, and learns the obtained value as the air-fuel ratio learning coefficient kg. When the learning of the air-fuel ratio learning coefficient kg progresses, the steady deviation of the air-fuel ratio correction coefficient faf from its reference value is absorbed by the air-fuel ratio learning coefficient kg, and the air-fuel ratio correction coefficient faf can be increased/decreased on either side of its reference value. To avoid the influence of air-fuel ratio changes that are caused by the supply of purge gas, the air-fuel ratio learning coefficient kg is learned while purge control is not exercised.

When the purge gas is purged by discharging it into the intake path 4 from the canister 40, the air-fuel ratio of the air-fuel mixture in the combustion chamber 16 changes due to the influence of the purge. Therefore, when purge control is exercised, the center of the air-fuel ratio correction coefficient faf begins to shift from its reference value toward the rich side. The symbol fpg in Equation (1) is a purge correction coefficient that is set to prevent the air-fuel ratio correction coefficient faf from being shifted by the above purge gas supply. As indicated in Equation (3) below, the purge correction coefficient fpg is calculated as the product of a density learning coefficient efgpg and the current purge ratio epgr:

$$fpg=efgpg\times epgr \quad (3)$$

The density learning coefficient efgpg in Equation (3) above is a learning value that corresponds to purge gas density (evaporative fuel density in the purge gas). The influence of purge gas supply upon the air-fuel ratio varies with the purge gas density. To ensure that the air-fuel ratio is accurately rendered close to the target air-fuel ratio, therefore, it is important that the purge gas density be determined. The ECU 30 learns the density learning coefficient efgpg, which corresponds to the purge gas density, from the steady deviation of the air-fuel ratio correction coefficient faf from its reference value during purge control. The density learning coefficient efgpg is expressed by Equation (4) below:

$$efgpg=efgpg+(tfafav/epgr) \quad (4)$$

The symbol efgpg on the left side of Equation (4) above is an updated density learning coefficient. The symbol efgpg on the right side of Equation (4) is an unupdated density learning coefficient. As described earlier, the symbol tfafav is an updating value that is set in accordance with the deviation between the smoothed value fafav of the air-fuel ratio correction coefficient faf and the reference value of the air-fuel ratio correction coefficient faf. As indicated in Equation (4) above, the ECU 30 calculates the updating value tfafav for each predetermined crank angle during purge control, adds up the ratios between the updating value tfafav and current purge ratio epgr, and learns the obtained value as the density learning coefficient efgpg. The higher the purge gas density, the greater the density learning coefficient efgpg. When the learning of the density learning coefficient efgpg progresses, the steady deviation of the air-fuel ratio correction coefficient faf from its reference value during purge control is absorbed by the density learning coefficient efgpg, and the air-fuel ratio correction coefficient faf can be increased/decreased on either side of its reference value.

[Description of Purge Control Exercised after Recovery from a Fuel Cut]

When, for instance, the upper-limit engine speed is reached or the accelerator pedal is released, the internal combustion engine 2 performs a fuel cut under predefined conditions. When a fuel cut is performed, the aforementioned purge control and air-fuel ratio feedback control operations are temporarily stopped. They are resumed upon recovery from the fuel cut. While the air-fuel ratio feedback control operation is halted, the aforementioned density learning coefficient efgpg is maintained at a value that prevailed immediately before the halt of the air-fuel ratio feedback control operation. It is updated when the air-fuel ratio feedback control operation is resumed. Since the air-fuel ratio is unstable for some time after air-fuel ratio feedback control operation resumption, it takes a certain amount of time before a highly accurate density learning coefficient efgpg is obtained. If the purge control operation is to be resumed after recovery from the fuel cut, it is therefore necessary to control the operation of the purge control valve 48 in such a manner as to prevent drivability from being impaired by air-fuel ratio discrepancy.

Figure 2:
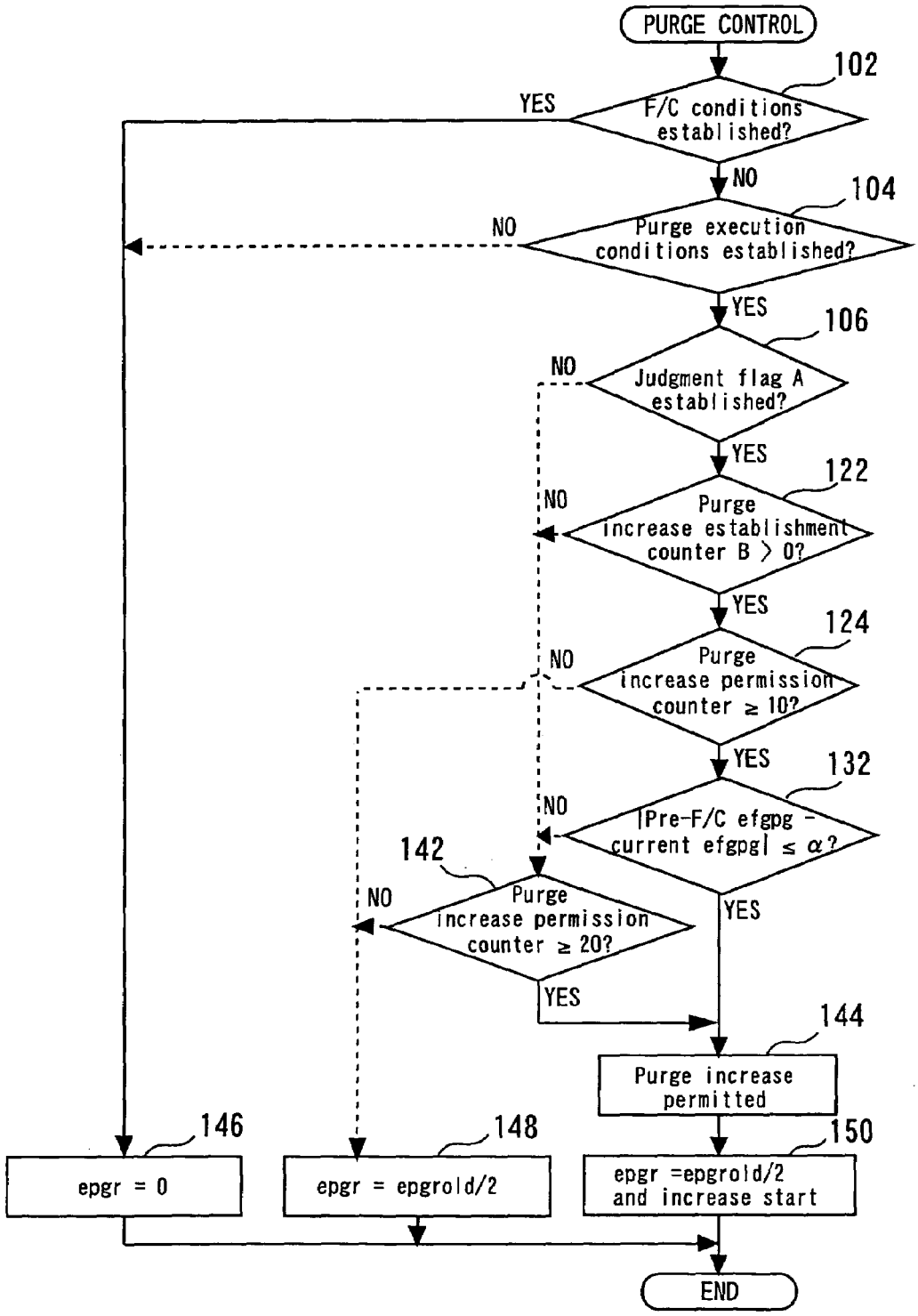
FIG. 2 is a flowchart illustrating a routine for purge control that is executed in accordance with the first embodiment of the present invention.

Purge control that is exercised by the ECU 30 during a fuel cut and after recovery from the fuel cut will now be described with reference to FIGS. 2 to 4. FIG. 2 is a flowchart illustrating operations that the ECU 30 performs during a fuel cut and after recovery from the fuel cut. A routine shown in FIG. 2 is repeatedly executed for each predetermined crank angle.

First of all, step 102 is performed to judge whether fuel cut (F/C) conditions are established. As described earlier, the fuel cut conditions are established when, for instance, the upper-limit engine speed is reached and the accelerator pedal is released. The output from the accelerator position sensor 38 is used to judge whether the accelerator pedal is released. When the judgment result indicates that the fuel cut conditions are established, the purge ratio epgr is set to zero (step 146). More specifically, the drive duty ratio of the purge control valve 48 is set to zero and the purge gas supply to the intake path 4 is shut off.

If the judgment result obtained in step 102 indicates that the fuel cut conditions are not established (e.g., the accelerator pedal is depressed again), steps 104 and beyond are performed. Step 104 is performed to judge whether the aforementioned purge execution conditions are established. If the purge execution conditions are not established, the flow proceeds to step 146 in which the purge ratio epgr is set to zero.

If, on the other hand, the purge execution conditions are established, query step 106 is performed. However, if, at first, the fuel cut conditions are not established, and then the purge execution conditions are established (this situation is not indicated in the flowchart), a purge increase permission counter begins to be incremented. The purge increase counter is incremented whenever the density leaning coefficient efgpg is updated. When the fuel cut conditions are established or the purge execution conditions are not established, the purge increase permission counter resets to zero.

Step 106 is performed to judge whether a frequent fuel cut operation judgment flag A is established. The term "frequent fuel cut operation" denotes an operation in which the accelerator pedal is operated to perform a fuel cut with a frequency that is higher than predefined. The frequent fuel cut operation judgment flag A is established (ON) when it is judged that a frequent fuel cut operation is performed, and is not established (is OFF) when it is judged that the frequent fuel cut operation is terminated. The method for frequent fuel cut operation judgment will be described later.

If the frequent fuel cut operation judgment flag A is not established, step 142 is performed to judge whether a first predetermined value (20 in the currently used example) is reached by the aforementioned purge increase permission counter. The period before the value 20 is reached by the purge increase permission counter is referred to as the purge resumption period. In accordance with a process performed in step 148, the purge ratio epgr is set to half epgrold that is the purge ratio set immediately before a fuel cut. More specifically, the purge gas flow rate is reduced to about half the target flow rate before the density learning coefficient efgpg is updated 20 times. Since the air-fuel ratio feedback control operation is halted at the time of a fuel cut, the learning accuracy of the density learning coefficient efgpg is low immediately after recovery from the fuel cut. Therefore, if the purge ratio epgr is suddenly raised to the target purge ratio, a great air-fuel ratio discrepancy may arise to the detriment of drivability. Under such circumstances, the purge ratio epgr is set low to restrain the purge gas flow rate for some time after recovery from a fuel cut so that the density learning coefficient efgpg is learned while the purge ratio epgr is low.

When the purge increase permission counter is incremented to 20 so that the purge resumption period terminates, step 144 is performed to permit the purge ratio epgr to increase to the target purge ratio. Whenever the purge ratio increase is permitted in step 144, a purge increase establishment counter B is incremented by one. The purge increase establishment counter B is incremented whenever the purge increase is permitted after ignition switch ON. This counter resets when the ignition switch is turned OFF. Unlike the aforementioned purge increase permission counter, the purge increase establishment counter B does not reset when a fuel cut is performed.

When the purge increase is permitted, step 150 is performed to control the operation of the purge control valve 48. In step 150, the purge ratio epgr is increased toward the target purge ratio for updating purposes. This ensures that the purge gas flow rate gradually increases toward the target flow rate after an elapse of the purge resumption period. The purge ratio increase speed is set within a range within which air-fuel ratio changes caused by an increase in the purge gas flow rate can be absorbed by air-fuel ratio feedback control.

If the judgment result obtained in step 106 indicates that the frequent fuel cut operation judgment flag A is established, the flow proceeds to step 122. Step 122 is performed to judge whether the count reached by the purge increase establishment counter B is greater than a predetermined value (0 in the current example). The purge increase establishment counter B indicates the number of times a process was performed to achieve recovery from a fuel cut after internal combustion engine startup. The greater the count reached by the purge increase establishment counter B, the larger the number of times the density learning coefficient efgpg is updated. It means that the density learning coefficient efgpg is learned to a great extent when the count reached by the purge increase establishment counter B is great. In other words, the purge increase establishment counter B indicates the extent to which the density learning coefficient efgpg is learned. If the count reached by the purge increase establishment counter B is still zero, step 142, which has been mentioned earlier, is performed because it is judged that the density learning coefficient efgpg is not sufficiently learned. If, on the other hand, the count reached by the purge increase establishment counter B is 1 or greater, step 124 is performed instead of step 142 because it is judged that the density learning coefficient efgpg is learned to a certain extent.

As is the case with step 142, step 124 is performed to judge whether the purge resumption period has elapsed. However, step 142 assumes that the purge resumption period lasts until the first predetermined value is reached by the purge increase permission counter, whereas step 124 assumes that the purge resumption period lasts until a second predetermined value (10 in the current example), which is smaller than the first predetermined value, is reached by the purge increase permission counter. In other words, the purge resumption period prevailing when the process performed in step 124 is selected is shorter than the purge resumption period prevailing when the process performed in step 142 is selected. Before the purge resumption period elapses, step 148 is performed to set the purge ratio epgr to half epgrold that is the purge ratio set immediately before a fuel cut.

When the purge increase permission counter reaches a count of 10 to terminate the purge resumption period, step 144 is performed to permit the purge ratio epgr to increase to the target purge ratio on condition that the query in step 132 be answered "YES." Step 132 is performed to compare the density learning coefficient efgpg prevailing before a fuel cut against the current density learning coefficient efgpg and judge whether a predetermined value a is exceeded by the determined deviation. If the deviation is not greater than the predetermined value $\alpha$, it is concluded that the learning accuracy of the density learning coefficient efgpg is sufficient. Therefore, the purge increase is permitted immediately. After the purge increase is permitted, the purge ratio epgr is increased toward the target purge ratio for updating purposes. Thus, the purge gas flow rate is gradually increased toward the target flow rate (step 150).

If the deviation between the density learning coefficient efgpg prevailing before a fuel cut and the density learning coefficient efgpg prevailing after the fuel cut is unduly great, it is highly probable that the learning accuracy of the density learning coefficient efgpg is still not adequate after recovery from a fuel cut. If the purge ratio epgr is raised in such a situation, a great air-fuel ratio discrepancy may arise. Therefore, if the predetermined value $\alpha$ is exceeded by the deviation, step 142 is performed without permitting the purge ratio increase. More specifically, the purge increase permission counter resumes counting, and the purge resumption period extends until the purge increase permission counter reaches a count of 20. The learning accuracy of the density learning coefficient efgpg increases with an increase in the purge resumption period. When the purge increase permission counter reaches a count of 20 and the extended purge resumption period elapses, the purge increase is permitted (step 144), and the purge ratio epgr increases toward the target purge ratio for updating purposes (step 150).

In the purge control routine described above, the purge control operation performed after recovery from a fuel cut varies depending on whether the frequent fuel cut operation judgment flag A is established. FIG. 3 is a timing diagram illustrating a purge control operation that is performed when the frequent fuel cut operation judgment flag A is not established (is OFF). From top to bottom, the indications, which change with time, are fuel cut ON/OFF, purge ratio epgr, frequent fuel cut operation judgment flag A ON/OFF, purge increase permission counter, and purge increase permission ON/OFF. FIG. 4 is a timing diagram illustrating a purge control operation that is performed when the frequent fuel cut operation judgment flag A is established (ON). From top to bottom, the indications, which change with time, are fuel cut ON/OFF, purge ratio epgr, frequent fuel cut operation judgment flag A ON/OFF, purge increase establishment counter B, purge increase permission counter, density learning coefficient efgpg, and purge increase permission ON/OFF.

Figure 3:
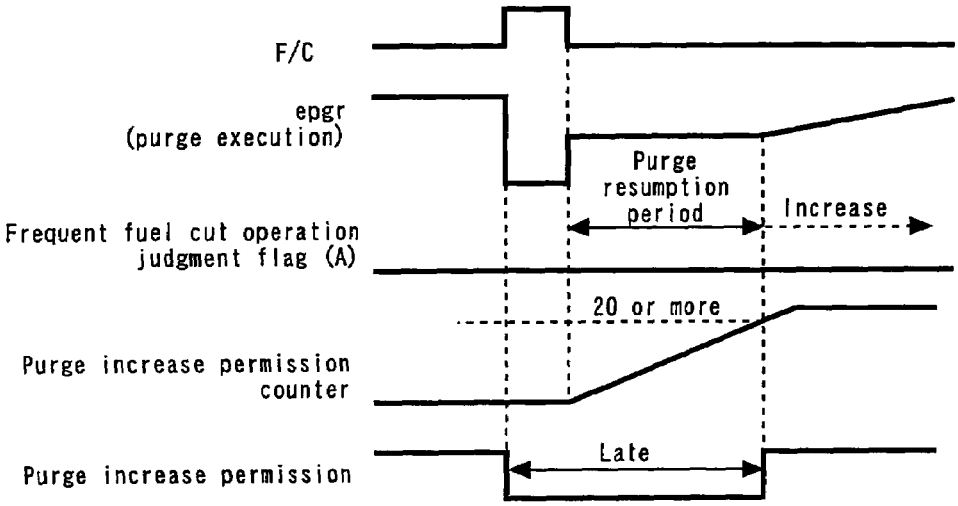
FIG. 3 is a timing diagram illustrating an example of the operation realized by the routine shown in FIG. 2.
Figure 4:
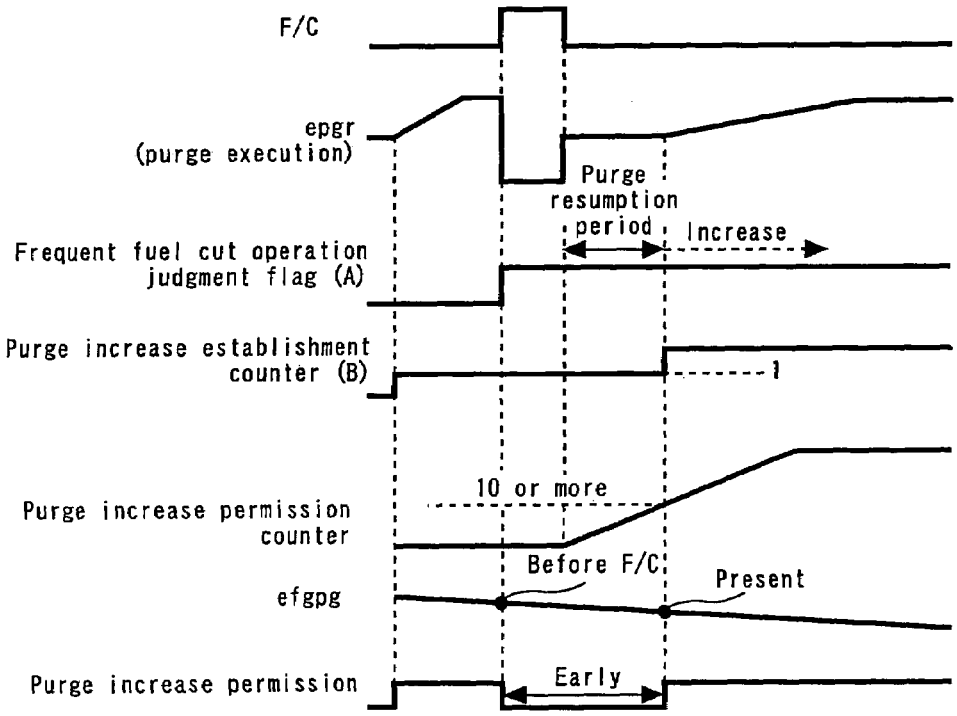
FIG. 4 is a timing diagram illustrating another example of the purge control operation realized by the routine shown in FIG. 2.

As is obvious from the comparison between the timing diagrams in FIGS. 3 and 4, the purge resumption period prevailing after recovery from a fuel cut is shorter when the frequent fuel cut operation judgment flag A is established than when the frequent fuel cut operation judgment flag A is not established. Therefore, the purge ratio epgr begins to increase earlier when the frequent fuel cut operation judgment flag A is established than when the frequent fuel cut operation judgment flag A is not established. Evaporative fuel is stored in the canister 40 even while a fuel cut is performed. In a situation where a fuel cut is frequently performed, therefore, the evaporative fuel cannot be adequately purged from the canister 40 so that the evaporative fuel may overflow the canister 40. In the purge control routine described above, however, the purge ratio epgr begins to increase earlier when a fuel cut is frequently performed than in a normal state. It is therefore possible to provide a purge gas flow rate for a steady operation earlier and adequately purge the evaporative fuel from the canister 40.

Further, if the purge gas flow rate is raised soon after recovery from a fuel cut, the air-fuel ratio may become overrich due to a delay in the learning of the density learning coefficient efgpg, thereby varying the vehicle's acceleration. However, when the frequent fuel cut operation judgment flag A is established, the driver frequently operates the accelerator pedal by intention. Therefore, the driver does not feel uncomfortable even when the acceleration varies to a certain extent. In other words, the purge control routine described above shortens the purge resumption period only when a fuel cut is performed frequently in accordance with accelerator pedal operation. Consequently, it is possible to sufficiently purge the evaporative fuel from the canister 40 without detriment to drivability.

However, if the learning accuracy of the density learning coefficient efgpg is unduly insufficient, the acceleration greatly varies due to a great air-fuel ratio discrepancy. Consequently, the driver may feel uncomfortable even when a frequent fuel cut operation is being performed. If there is an unduly great deviation between the density learning coefficient efgpg prevailing before a fuel cut and the density learning coefficient efgpg prevailing after the fuel cut, the purge control routine described above uses a normal purge resumption period without shortening it. This ensures that the purge gas flow rate does not increase early even when the learning accuracy of the density learning coefficient efgpg is inadequate. As a result, the purge control routine described above avoids a significant air-fuel ratio discrepancy.

[Description of a Frequent Fuel Cut Operation Judgment Method]

Figure 5:
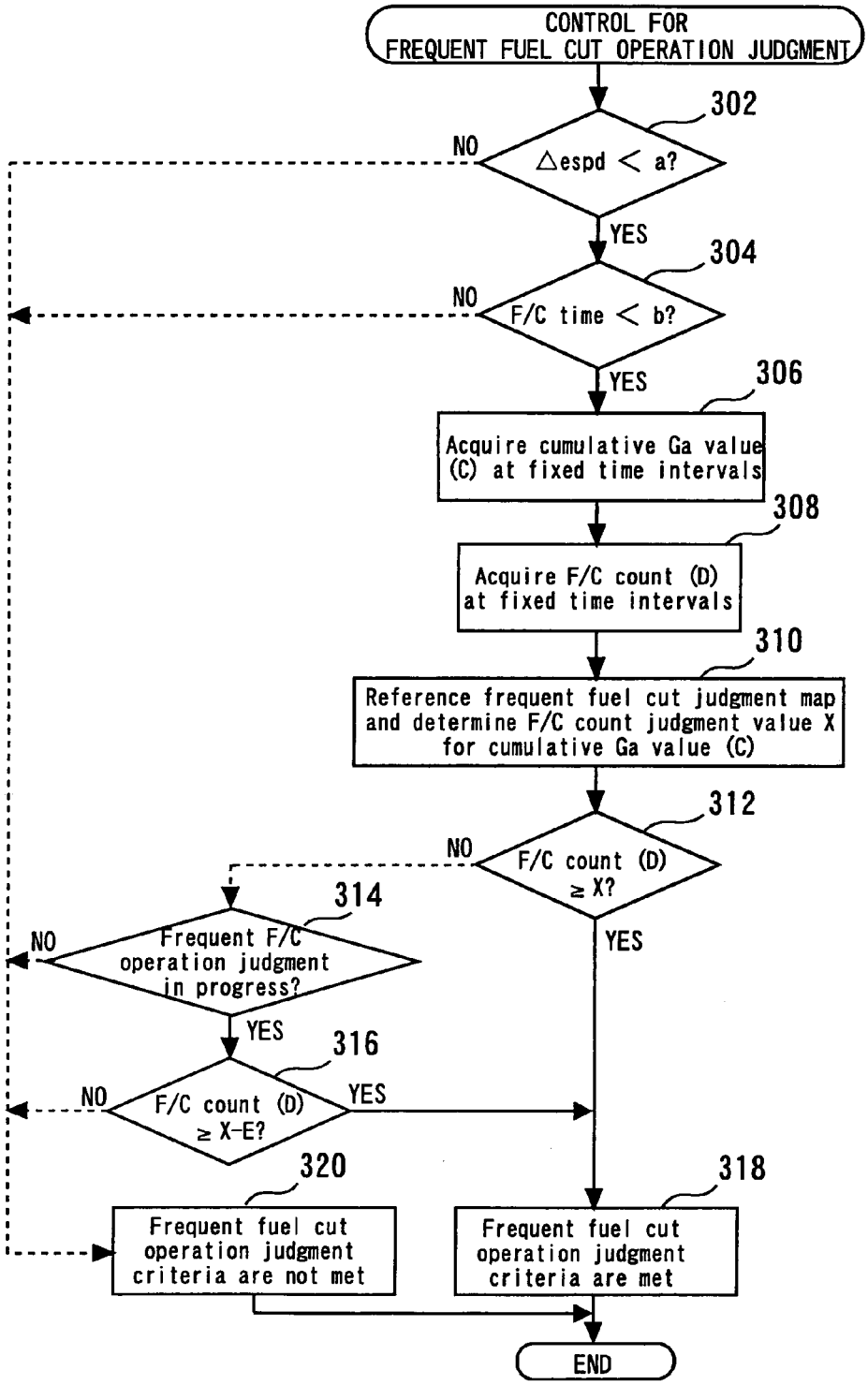
FIG. 5 is a flowchart illustrating a routine for frequent fuel cut operation judgment that is executed in accordance with the first embodiment of the present invention.

A frequent fuel cut operation judgment method will now be described in detail with reference to FIGS. 5 to 8. FIG. 5 is a flowchart illustrating how the ECU 30 exercises control for frequent fuel cut operation judgment. The routine shown in FIG. 5 is repeatedly executed for each predetermined crank angle.

First of all, step 302 is performed to determine the engine speed change rate Δespd of the internal combustion engine 2 and judge whether the change rate Δespd is smaller than a predetermined value a. It is assumed that a frequent fuel cut operation occurs when the driver frequently operates the accelerator pedal to maintain the vehicle speed within a certain range. An operation in which the engine speed change rate Δespd is high and sudden acceleration and deceleration are performed is not regarded as a frequent fuel cut operation. Therefore, if the engine speed change rate Δespd is not smaller than the predetermined value a, frequent fuel cut operation judgment criteria are not met (step 320). However, the engine speed change rate Δespd may increase during a frequent fuel cut operation depending on the driver's habit. Therefore, step 302 is not mandatory and may be skipped.

If the engine speed change rate Δespd is smaller than the predetermined value a, step 304 is performed to judge whether the duration of a fuel cut operation (F/C time) is shorter than a predetermined period of time b. The judgment formulated in step 304 is for forcibly terminating a situation where the frequent fuel cut operation judgment criteria are met. When a fuel cut operation is performed for an extended period of time, the evaporative fuel stored in the canister 40 during such a period may provide a higher purge gas density after recovery from a fuel cut than before the fuel cut. If a large amount of such a high-density purge gas is supplied in a situation where the density learning coefficient efgpg is not sufficiently learned, a significant air-fuel ratio discrepancy may arise. As such being the case, a situation where the frequent fuel cut operation judgment criteria are met is forcibly terminated when the duration of a fuel cut operation exceeds the predetermined period of time b. The normal purge resumption period is obtained in this manner to enhance the learning accuracy of the density learning coefficient efgpg.

If the query in step 304 is answered "YES," steps 306 and beyond are performed to judge whether the frequent fuel cut operation judgment criteria are met. The relationship between the cumulative intake air flow amount Ga (cumulative Ga) per fixed time and the fuel cut operation count (F/C count) per fixed time is used to judge whether the frequent fuel cut operation judgment criteria are met. The fuel cut operation count represents the number of times a fuel cut is performed by operating the accelerator pedal. The output from the accelerator position sensor 38 can be used to judge whether a fuel cut is performed by operating the accelerator pedal. In step 306, a cumulative Ga value C per fixed past time is acquired. In step 308, an F/C count D per fixed past time is acquired. The ECU 30 executes another routine to calculate the above cumulative Ga value and F/C count for each predetermined crank angle.

Figure 6:
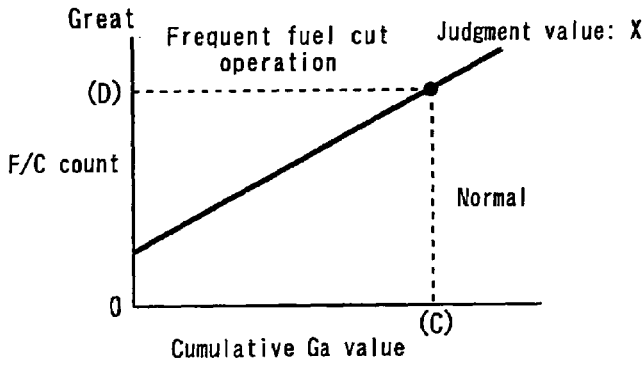
FIG. 6 is an example of the map used in the routine shown in FIG. 5.

As indicated in FIG. 6, the ECU 30 has a frequent fuel cut judgment map. This map sets an F/C count for each cumulative Ga value to define the boundary between a frequent fuel cut operation and normal operation. In step 310, the frequent fuel cut judgment map shown in FIG. 6 is used to determine an F/C count judgment value X for a cumulative Ga value that is acquired in step 306. The judgment value X is a value on the boundary between a normal operation and a frequent fuel cut operation corresponding to the cumulative Ga value C within the frequent fuel cut judgment map. In the next step (step 312), the F/C count D acquired in step 308 is compared against the judgment value X. If the result of comparison indicates that the F/C count D is not smaller than the judgment value X, the frequent fuel cut operation judgment criteria are met (step 318).

If the F/C count D is smaller than the judgment value X, the process to be performed varies depending on whether the frequent fuel cut operation judgment criteria were met in the last cycle. When the frequent fuel cut operation judgment criteria were not met in the last cycle, it is concluded that the frequent fuel cut operation judgment criteria are not met (step 320). If, on the other hand, the frequent fuel cut operation judgment criteria were met in the last cycle, a predetermined value E is subtracted from the judgment value X, and then the resultant value is compared against the F/C count D. If the result of comparison indicates that the F/C count D is smaller than X−E, the frequent fuel cut operation judgment criteria are not met (step 320). However, if the F/C count D is not smaller than X−E, it is concluded that the frequent fuel cut operation judgment criteria are met (step 318).

Figure 7:
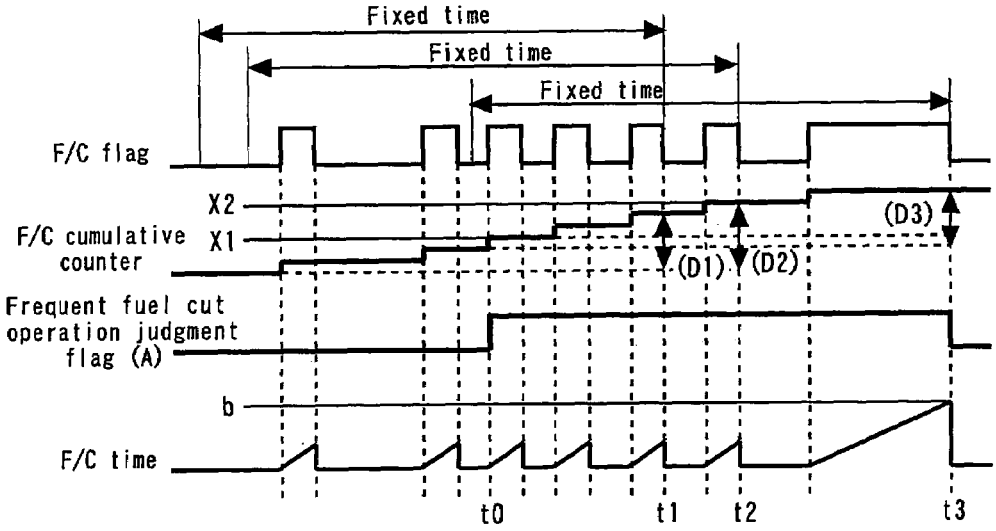
FIG. 7 is a timing diagram illustrating an example of the operation realized by the routine shown in FIG. 5.
Figure 8:
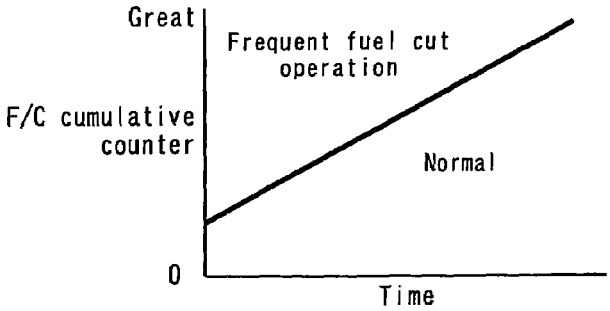
FIG. 8 is another example of the map used in the routine shown in FIG. 5.

FIG. 7 is a timing diagram illustrating a typical operation that is performed by a control routine for frequent fuel cut operation judgment that has been described above. From top to bottom, the timing diagram indications, which change with time, are fuel cut ON/OFF, F/C cumulative counter, frequent fuel cut operation judgment flag A ON/OFF, and F/C time. The F/C cumulative counter is incremented each time a fuel cut is performed. The F/C count D per fixed time is determined from the value of the F/C cumulative counter. In FIG. 7, F/C counts D1, D2, and D3 prevailing at time t1, time r2, and time t3 are indicated by the lengths of arrows.

After the frequent fuel cut operation judgment flag A is established (at time t0), a frequent fuel cut operation judgment process is performed for each predetermined crank angle. For frequent fuel cut operation judgment purposes, each of the prevailing F/C counts D is compared against a judgment value X for the prevailing cumulative Ga value. In FIG. 7, F/C counts D1 and D2, which prevail at time t1 and time t2, are compared against judgment values X1 and X2. The results of comparison indicate that F/C counts D1 and D2 are both greater than judgment values X1 and X2. Therefore, the frequent fuel cut operation judgment flag A is established. The frequent fuel cut operation judgment process is also performed to judge whether a predetermined period of time b is exceeded by the F/C time. In FIG. 7, the F/C time is equivalent to the predetermined period of time b at time t3. In this instance, the situation where the frequent fuel cut operation judgment flag A is established is forcibly terminated without comparing F/C count D3, which prevails at time t3, against the judgment value X.

The control routine for frequent fuel cut operation judgment described above examines the relationship between the cumulative intake air flow amount Ga and fuel cut execution count to judge whether the frequent fuel cut operation judgment criteria are met. However, as indicated in the map shown in FIG. 8, the relationship between the F/C cumulative counter and time may be examined to judge whether the frequent fuel cut operation judgment criteria are met. An alternative is to count the number of times the idle switch was turned ON instead of counting the number of fuel cut operations performed.

Second Embodiment

A second embodiment of the present invention will now be described with reference to FIGS. 9 to 11.

Figure 9:
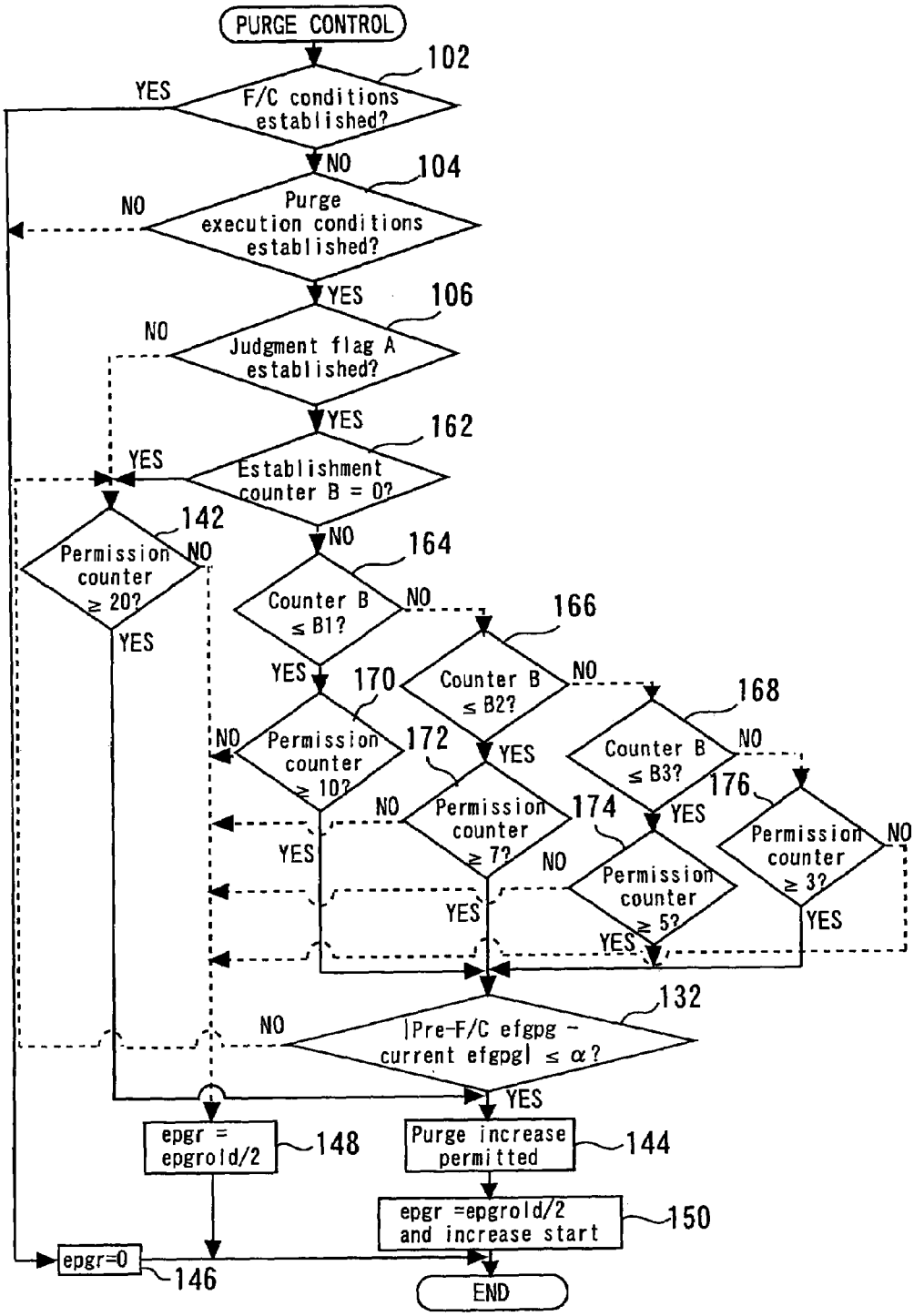
FIG. 9 is a flowchart illustrating a routine for purge control that is executed in accordance with the second embodiment of the present invention.

An evaporative fuel processing device according to the second embodiment of the present invention can be implemented when the first embodiment causes the ECU 30 to execute a routine shown in FIG. 9 instead of the routine shown in FIG. 2.

FIG. 9 is a flowchart illustrating purge control operations that the ECU 30 performs during a fuel cut and after recovery from the fuel cut. A routine shown in FIG. 9 is repeatedly executed for each predetermined crank angle. In FIG. 9, steps for performing the same processes as the steps indicated in FIG. 2 are numbered the same as indicated in FIG. 2. The steps that have been described in conjunction with the first embodiment are not repeatedly described herein. The subsequent description mainly deals with processing steps that are unique to the second embodiment.

When the judgment result obtained in step 106 indicates that the frequent fuel cut operation judgment flag A is established, the first embodiment judges whether the count reached by the purge increase establishment counter B is greater than zero (step 122). When the count reached by the purge increase establishment counter B is greater than zero, the first embodiment selects the process to be performed in step 124 without regard to the magnitude of the value reached by the purge increase establishment counter B. On the other hand, the second embodiment notes the count reached by the purge increase establishment counter B and selects the next process to be performed accordingly when the count reached by the purge increase establishment counter B is greater than zero.

Step 162 is performed immediately after the query in step 106 is answered "YES" in order to judge whether the count reached by the purge increase establishment counter B is zero. When the count reached by the purge increase establishment counter B is zero, the second embodiment performs step 142 as is the case with the first embodiment. In this instance, the purge resumption period lasts until the purge increase permission counter reaches a count of 20 (first predetermined value).

If the count reached by the purge increase establishment counter B is greater than zero, step 164 is performed next to judge whether the count reached by the purge increase establishment counter B is smaller than judgment value B1. Judgment value B1 is an integer that is greater than zero. When the count reached by the purge increase establishment counter B is smaller than judgment value B1, the flow proceeds to step 170. Step 170 is performed to judge whether the second predetermined value (10 in the current example), which is smaller than the first predetermined value, is reached by the purge increase permission counter. The flow proceeds to step 148 before a count of 10 is reached by the purge increase permission counter. When a count of 10 is reached by the purge increase permission counter, the flow proceeds to step 132. In this instance, the purge resumption period lasts until the purge increase permission counter reaches a count of 10 (second predetermined value).

When the count reached by the purge increase establishment counter B is greater than judgment value B1, step 166 is performed next to judge whether the count reached by the purge increase establishment counter B is not greater than judgment value B2. Judgment value B2 is an integer that is greater than judgment value B1. When the count reached by the purge increase establishment counter B is not greater than judgment value B2, the flow proceeds to step 172. Step 172 is performed to judge whether a third predetermined value (7 in the current example), which is smaller than the second predetermined value, is reached by the purge increase permission counter. The flow proceeds to step 148 before the purge increase permission counter reaches a count of 7. When the purge increase permission counter reaches a count of 7, the flow proceeds to step 132. In this instance, the purge resumption period lasts until the purge increase permission counter reaches a count of 7 (third predetermined value).

When the count reached by the purge increase establishment counter B is greater than judgment value B2, step 168 is performed next to judge whether the count reached by the purge increase establishment counter B is not greater than judgment value B3. Judgment value B3 is an integer that is greater than judgment value B2. When the count reached by the purge increase establishment counter B is not greater than judgment value B3, the flow proceeds to step 174. Step 174 is performed to judge whether a fourth predetermined value (5 in the current example), which is smaller than the third predetermined value, is reached by the purge increase permission counter. The flow proceeds to step 148 before the purge increase permission counter reaches a count of 5. When the purge increase permission counter reaches a count of 5, the flow proceeds to step 132. In this instance, the purge resumption period lasts until the purge increase permission counter reaches a count of 5 (fourth predetermined value).

When the count reached by the purge increase establishment counter B is greater than judgment value B3, the flow proceeds to step 176. Step 176 is performed to judge whether a fifth predetermined value (3 in the current example), which is smaller than the fourth predetermined value, is reached by the purge increase permission counter. The flow proceeds to step 148 before the purge increase permission counter reaches a count of 3. When the purge increase permission counter reaches a count of 3, the flow proceeds to step 132. In this instance, the purge resumption period lasts until the purge increase permission counter reaches a count of 3 (fifth predetermined value).

Figure 10:
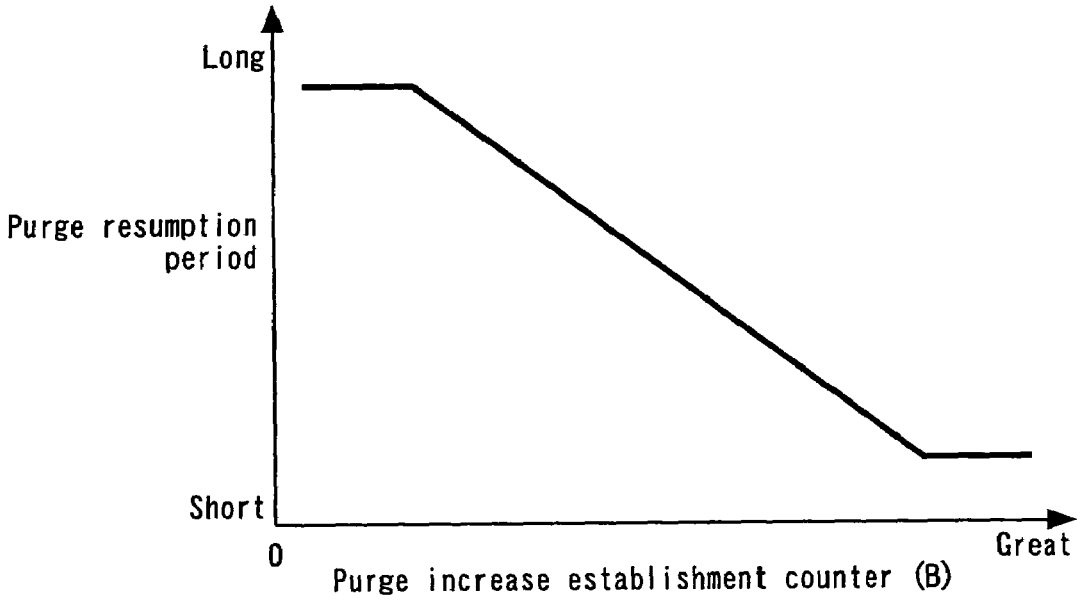
FIG. 10 is a map used in the routine shown in FIG. 9.

As indicated in FIG. 10, the purge control routine described above decreases the purge resumption period with an increase in the count reached by the purge increase establishment counter B. As described earlier, the purge increase establishment counter B indicates the extent to which the density learning coefficient efgpg is learned. It can be concluded that the greater the count reached by the purge increase establishment counter B, the higher the learning accuracy of the density learning coefficient efgpg. Therefore, while the purge resumption period remains unchanged, it is conceivable that the degree of air-fuel ratio discrepancy caused by purge gas supply after recovery from a fuel cut decreases with an increase in the count reached by the purge increase establishment counter B. The purge control routine described above shortens the purge resumption period when the count reached by the purge increase establishment counter B increases, that is, when the number of times the density learning coefficient efgpg is learned increases. Thus, the purge control routine makes it possible to provide a purge gas flow rate for a steady operation earlier and adequately purge the evaporative fuel from the canister 40.

Figure 11:
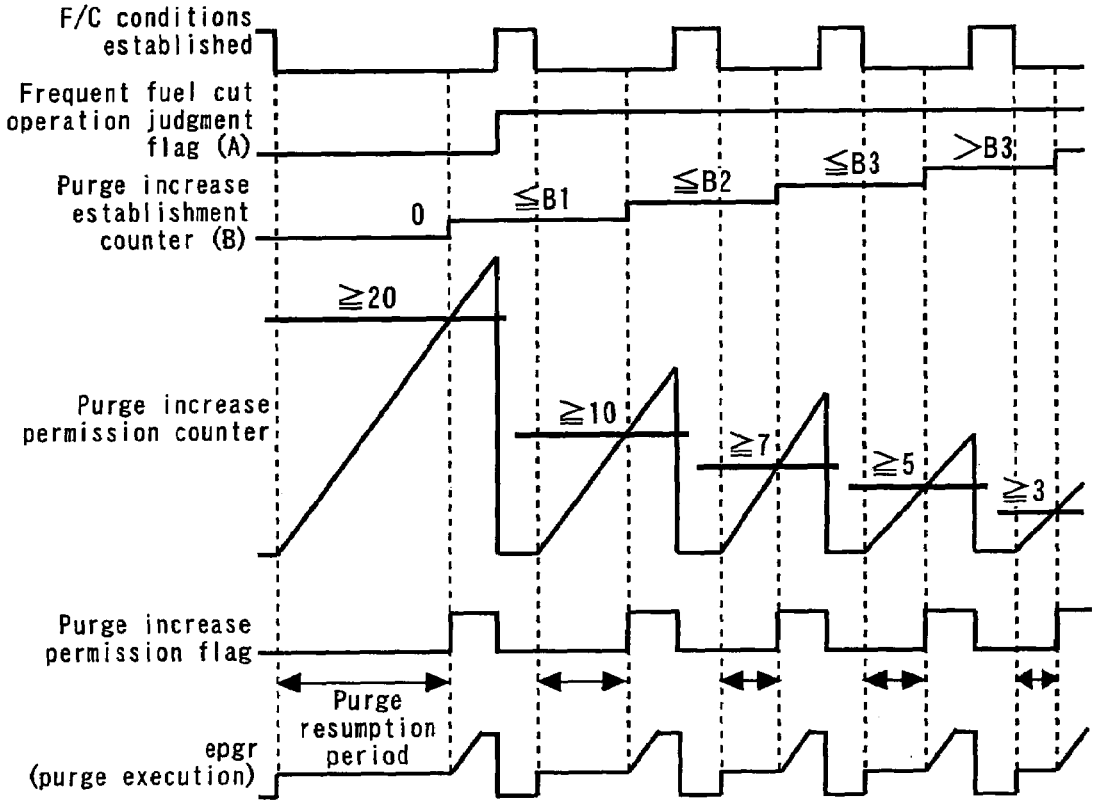
FIG. 11 is a timing diagram illustrating an example of the operation realized by the routine shown in FIG. 9.

FIG. 11 is a timing diagram illustrating a typical operation that is performed by the purge control routine described above. From top to bottom, the timing diagram indications, which change with time, are fuel cut ON/OFF, frequent fuel cut operation judgment flag A ON/OFF, purge increase establishment counter B, purge increase permission counter, purge increase permission ON/OFF, and purge ratio epgr. As indicated in FIG. 11, the count reached by the purge increase establishment counter B increases each time a fuel cut is performed. The purge increase permission counter judgment value decreases from 20 to 10, 7, 5, and 3 as the count reached by the purge increase establishment counter B increases. Consequently, the purge resumption period decreases with an increase in the frequency with which a fuel cut is performed. As a result, the purge gas flow rate increases earlier after recovery from a fuel cut.

Third Embodiment

A third embodiment of the present invention win now be described with reference to FIGS. 12 to 15.

Figure 12:
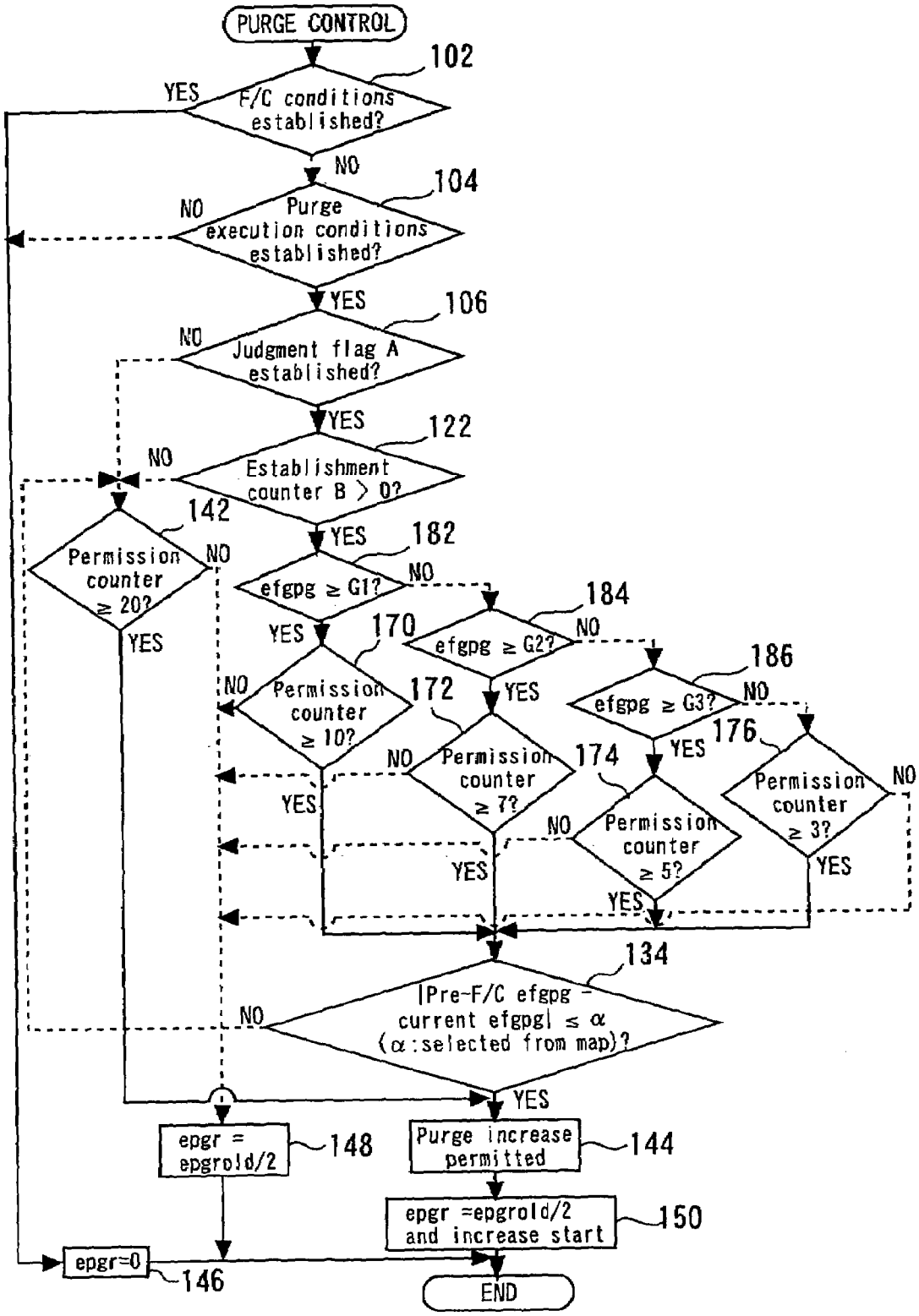
FIG. 12 is a flowchart illustrating a routine for purge control that is executed in accordance with the third embodiment of the present invention.
Figure 13:
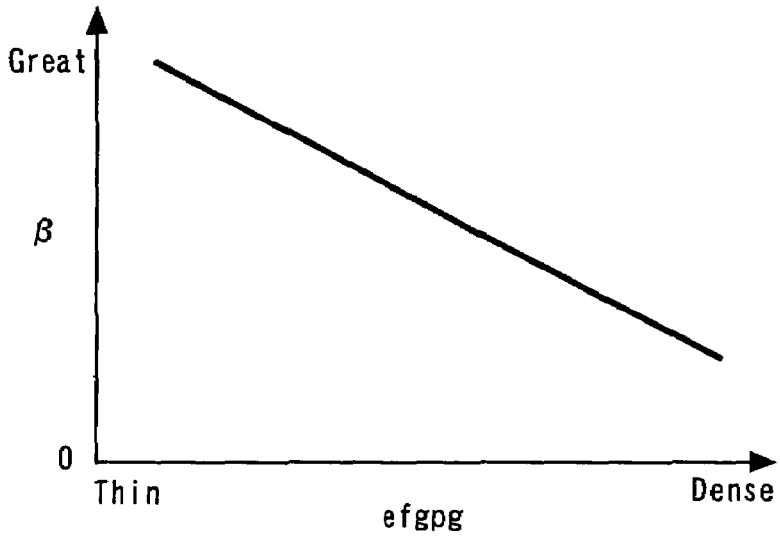
FIG. 13 is a map used in the routine shown in FIG. 12.

An evaporative fuel processing device according to the third embodiment of the present invention can be implemented when the first embodiment causes the ECU 30 to execute a routine shown in FIG. 12 instead of the routine shown in FIG. 2.

FIG. 12 is a flowchart illustrating purge control operations that the ECU 30 performs during a fuel cut and after recovery from the fuel cut. A routine shown in FIG. 12 is repeatedly executed for each predetermined crank angle. In FIG. 12, steps for performing the same processes as the steps indicated in FIG. 2 or 9 are numbered the same as indicated in FIG. 2 or 9. The steps that have been described in conjunction with the first or second embodiment are not repeatedly described herein. The subsequent description mainly deals with processing steps that are unique to the third embodiment.

When the judgment result obtained in step 122 indicates that the count reached by the purge increase establishment counter B is greater than zero, the first embodiment selects the process in step 124 and the second embodiment selects the next process to be performed in accordance with the count reached by the purge increase establishment counter B. However, the third embodiment selects the next process to be performed in accordance with the purge gas density, that is, the magnitude of the density learning coefficient efgpg.

First of all, step 182 is performed immediately after the query in step 122 is answered "YES" to judge whether the density learning coefficient efgpg is not smaller than judgment value G1. When the density learning coefficient efgpg is not smaller than judgment value G1, step 170 is performed to judge whether the second predetermined value (10 in the current example), which is smaller than the first predetermined value, is reached by the purge increase permission counter. The flow proceeds to step 148 before the purge increase permission counter reaches a count of 10. When the purge increase permission counter reaches a count of 10, the flow proceeds to step 134. In this instance, the purge resumption period lasts until the purge increase permission counter reaches a count of 10 (second predetermined value).

When the density learning coefficient efgpg is smaller than judgment value G1, step 184 is performed to judge whether the density learning coefficient efgpg is not smaller than judgment value G2. Judgment value G2 is smaller than judgment value G1. When the density learning coefficient efgpg is not smaller than judgment value G2, step 172 is performed to judge whether the third predetermined value (7 in the current example), which is smaller than the second predetermined value, is reached by the purge increase permission counter. The flow proceeds to step 148 before the purge increase permission counter reaches a count of 7. When the purge increase permission counter reaches a count of 7, the flow proceeds to step 134. In this instance, the purge resumption period lasts until the purge increase permission counter reaches a count of 7 (third predetermined value).

When the density leaning coefficient efgpg is smaller than judgment value G2, step 186 is performed to judge whether the density learning coefficient efgpg is not smaller than judgment value G3. Judgment value G3 is smaller than judgment value G2. When the density learning coefficient efgpg is not smaller than judgment value G3, step 174 is performed to judge whether the fourth predetermined value (5 in the current example), which is smaller than the third predetermined value, is reached by the purge increase permission counter. The flow proceeds to step 148 before the purge increase permission counter reaches a count of 5. When the purge increase permission counter reaches a count of 5, the flow proceeds to step 134. In this instance, the purge resumption period lasts until the purge increase permission counter reaches a count of 5 (fourth predetermined value).

When the density learning coefficient efgpg is smaller than judgment value G3, step 176 is performed to judge whether the fifth predetermined value (3 in the current example), which is smaller than the fourth predetermined value, is reached by the purge increase permission counter. The flow proceeds to step 148 before the purge increase permission counter reaches a count of 3. When the purge increase permission counter reaches a count of 3, the flow proceeds to step 134. In this instance, the purge resumption period lasts until the purge increase permission counter reaches a count of 3 (fifth predetermined value).

As is the case with step 132, which is performed in the first embodiment, step 134 is performed to compare the current density learning coefficient efgpg against the density learning coefficient efgpg prevailing before a fuel cut, and determine the deviation between these two coefficients. Step 132 is performed to judge whether the determined deviation is not greater than predetermined fixed value $\alpha$. However, step 134 is performed to judge whether the determined deviation is not greater than judgment value $\beta$, which is determined according to the current density learning coefficient efgpg. The ECU 30 references the map shown in FIG. 13 and determines judgment value $\beta$ in accordance with the current density leaning coefficient efgpg. Judgment value $\beta$ is set so that it increases with a decrease in the density learning coefficient efgpg, that is, increases with a decrease in the purge gas density. When the obtained judgment result indicates that the deviation is not greater than judgment value β, the purge increase is immediately permitted (step 144). If, on the other hand, the deviation is greater than judgment value β, step 142 is performed.

Figure 14:
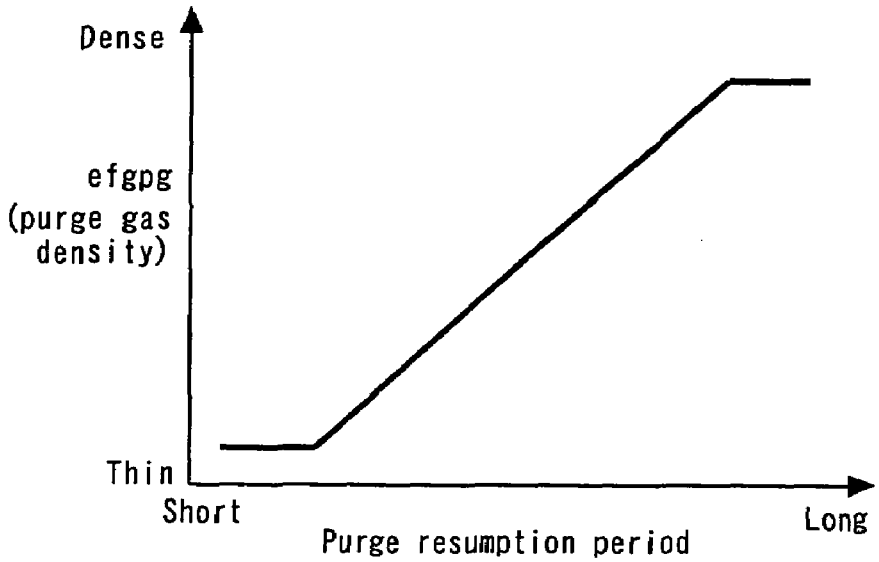
FIG. 14 is another map used in the routine shown in FIG. 12.

As indicated in FIG. 14, the purge control routine described above ensures that the purge resumption period decreases with a decrease in the density learning coefficient efgpg, that is, decreases with a decrease in the purge gas density. The influence of purge gas supply upon the air-fuel ratio decreases with a decrease in the purge gas density. Therefore, if the purge ratio epgr begins to increase while the purge gas density is low, it is conceivable that an air-fuel ratio discrepancy is not likely to arise due to a delay in the learning of the density learning coefficient efgpg. The purge control routine described above causes the purge resumption period to decrease with a decrease in the density learning coefficient efgpg, that is, decrease with a decrease in the purge gas density, thereby making it possible to provide a purge gas flow rate for a steady operation earlier and adequately purge the evaporative fuel from the canister 40.

If the learning accuracy of the density learning coefficient efgpg is unduly insufficient, a great air-fuel discrepancy may arise, causing the driver to feel uncomfortable even when a frequent fuel cut operation is being performed. Therefore, if the learning accuracy of the density learning coefficient efgpg is insufficient, it is preferred that the purge resumption period be prohibited from being shortened, and that the purge ratio epgr be raised after the learning accuracy of the density leaning coefficient efgpg is increased. However, even if the learning accuracy of the density learning coefficient efgpg is insufficient, the increase in the purge ratio epgr incurs a small air-fuel ratio discrepancy as far as the purge gas density is low. When judging whether or not to prohibit the purge resumption period from being shortened in accordance with the deviation between the density leaning coefficient efgpg prevailing before a fuel cut and the density learning coefficient efgpg prevailing after the fuel cut, the purge control routine described above sets the associated judgment value β in accordance with the current density learning coefficient efgpg. As a result, the purge ratio epgr begins to increase at the earliest possible time without incurring a great air-fuel ratio discrepancy.

Figure 15:
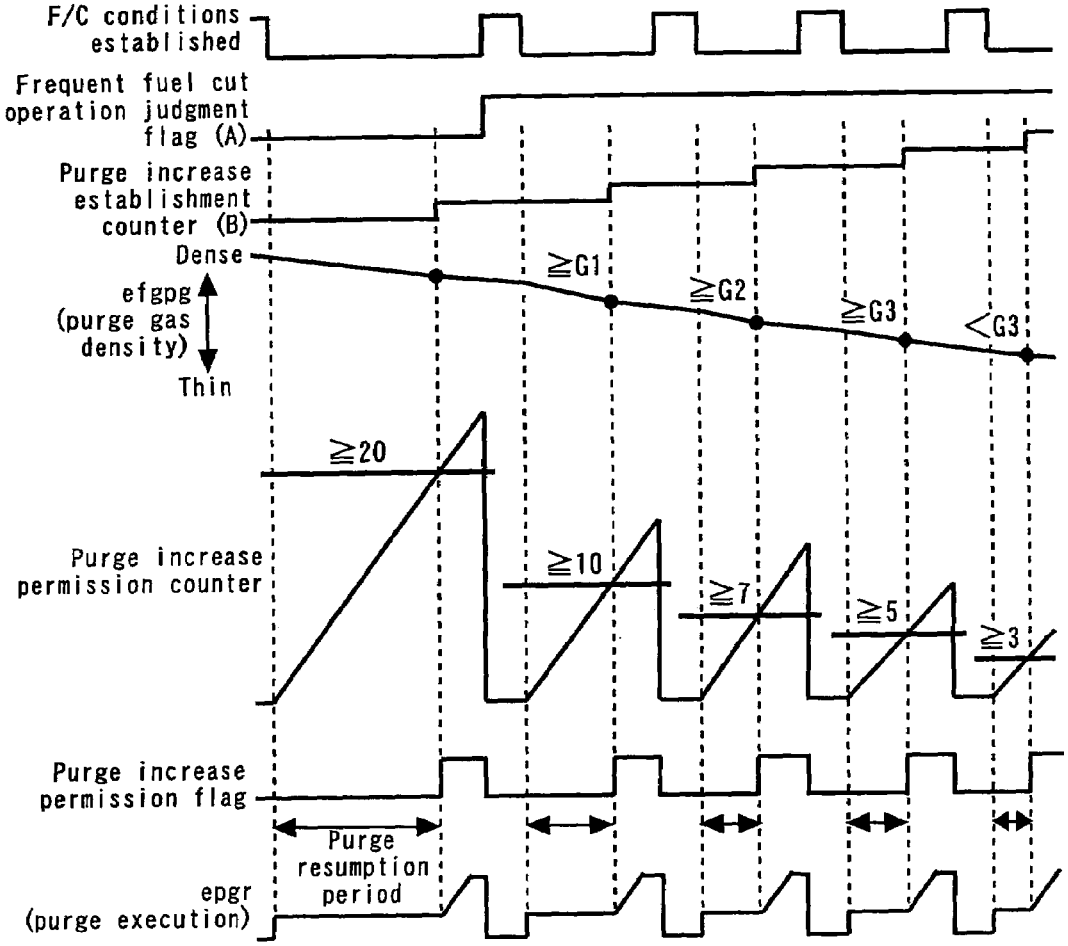
FIG. 15 is a timing diagram illustrating an example of the operation realized by the routine shown in FIG. 12.

FIG. 15 is a timing diagram illustrating a typical operation that is performed by the purge control routine described above. From top to bottom, the timing diagram indications, which change with time, are fuel cut ON/OFF, frequent fuel cut operation judgment flag A ON/OFF, purge increase establishment counter B, density learning coefficient efgpg, purge increase permission counter, purge increase permission ON/OFF, and purge ratio epgr. When the evaporative fuel is considerably purged out of the canister 40 so that the density leaning coefficient efgpg gradually decreases with a decrease in the purge gas density, the judgment value for the purge increase permission counter decreases from 20 to 10, 7, 5, and 3 in accordance with a decrease in the density learning coefficient efgpg, as indicated in FIG. 15. As a result, the purge resumption period decreases with a decrease in the density leaning coefficient efgpg. Consequently, the purge gas flow rate increases earlier after recovery from a fuel cut.

Fourth Embodiment

A fourth embodiment of the present invention will now be described with reference to FIGS. 16 to 18.

Figure 16:
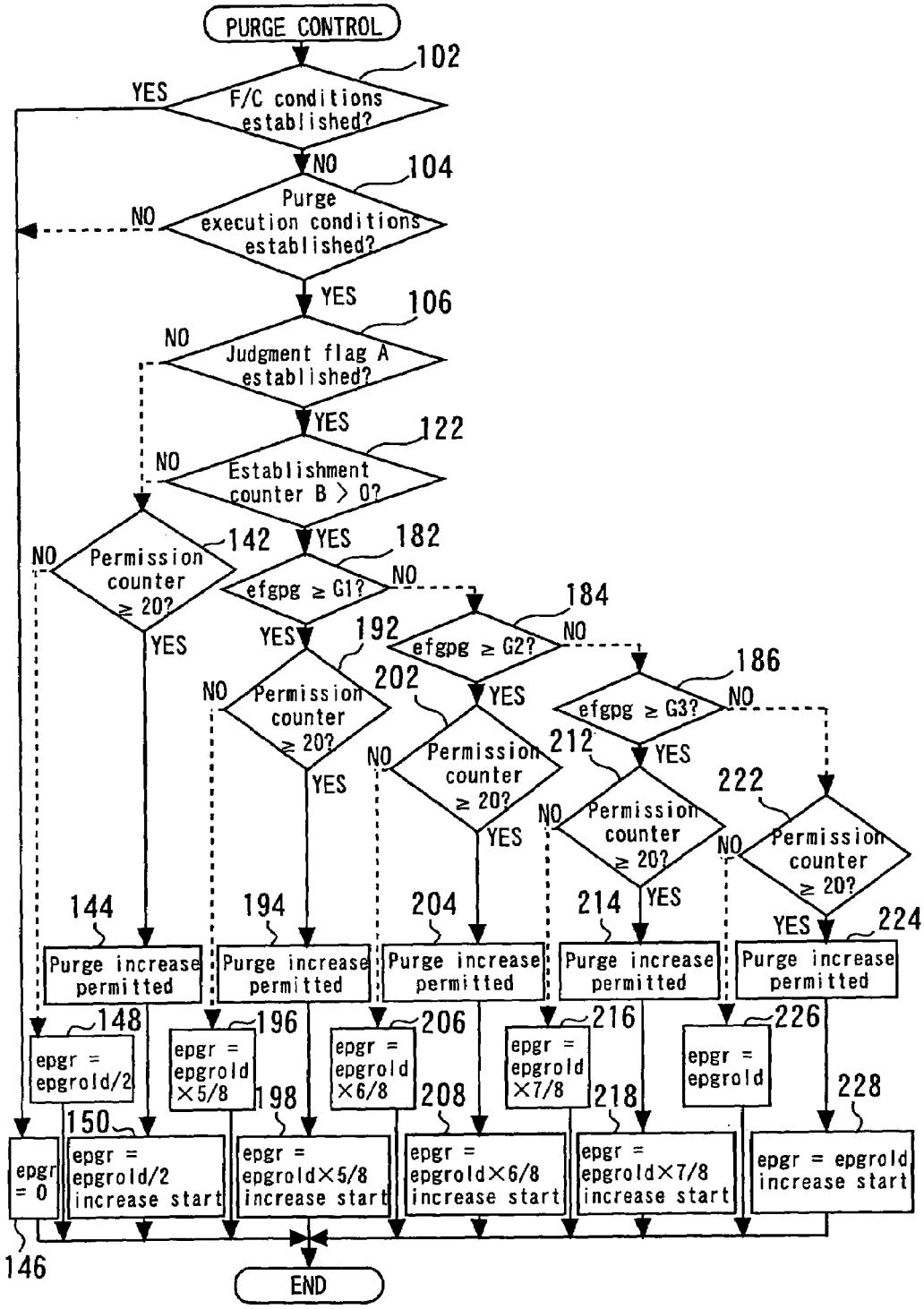
FIG. 16 is a flowchart illustrating a routine for purge control that is executed in accordance with the fourth embodiment of the present invention.

An evaporative fuel processing device according to the fourth embodiment of the present invention can be implemented when the first embodiment causes the ECU 30 to execute a routine shown in FIG. 16 instead of the routine shown in FIG. 2.

FIG. 16 is a flowchart illustrating purge control operations that the ECU 30 performs during a fuel cut and after recovery from the fuel cut. A routine shown in FIG. 16 is repeatedly executed for each predetermined crank angle. In FIG. 16, steps for performing the same processes as the steps indicated in FIG. 2 or 12 are numbered the same as indicated in FIG. 2 or 12. The steps that have been described in conjunction with the first or third embodiment are not repeatedly described herein. The subsequent description mainly deals with processing steps that are unique to the fourth embodiment.

When the judgment result obtained in step 122 indicates that the count reached by the purge increase establishment counter B is greater than zero, the third embodiment varies the purge resumption period setting in accordance with the magnitude of the density leaning coefficient efgpg. However, the fourth embodiment does not vary the purge resumption period, but varies the purge ratio setting for the purge resumption period (hereinafter referred to as the resumption purge ratio) in accordance with the magnitude of the density learning coefficient efgpg.

First of all, step 182 is performed after the query in step 122 is answered "YES" to judge whether the density learning coefficient efgpg is not smaller than judgment value G1. When the density learning coefficient efgpg is not smaller than judgment value G1, step 192 is performed to judge whether the first predetermined value (20 in the current example) is reached by the purge increase permission counter. As is the case where the frequent fuel cut operation judgment flag A is OFF or the count reached by the purge increase establishment counter B is zero, the purge resumption period lasts until the purge increase permission counter reaches a count of 20. The flow proceeds to step 196 before the obtained judgment result indicates that a count of 20 is reached by the purge increase permission counter, and the purge ratio epgr is set as the resumption purge ratio. In step 196, the resumption purge ratio is set to 5/8 epgrold that is the purge ratio set immediately before a fuel cut. When the obtained judgment result indicates that a count of 20 is reached by the purge increase permission counter, the purge increase is permitted (step 194), and the purge ratio epgr is increased from the resumption purge ratio toward the target purge ratio for updating purposes (step 198).

When the density learning coefficient efgpg is smaller than judgment value G1, step 184 is performed to judge whether the density learning coefficient efgpg is not smaller than judgment value G2. When the density learning coefficient efgpg is not smaller than judgment value G2, step 202 is performed. The process performed in step 202 is the same as the process performed in step 192. More specifically, step 202 is performed to judge whether a count of 20 is reached by the purge increase permission counter. The flow proceeds to step 206 before the obtained judgment result indicates that a count of 20 is reached by the purge increase permission counter, and the purge ratio epgr is set as the resumption purge ratio. In step 206, the resumption purge ratio is set to 6/8 epgrold that is the purge ratio set immediately before a fuel cut. When the obtained judgment result indicates that a count of 20 is reached by the purge increase permission counter, the purge increase is permitted (step 204), and the purge ratio epgr is increased from the resumption purge ratio toward the target purge ratio for updating purposes (step 208).

When the density learning coefficient efgpg is smaller than judgment value G2, step 186 is performed to judge whether the density learning coefficient efgpg is not smaller than judgment value G3. When the density learning coefficient efgpg is not smaller than judgment value G3, step 212 is performed. The process performed in step 212 is the same as the process performed in step 192. More specifically, step 212 is performed to judge whether a count of 20 is reached by the purge increase permission counter. Before the obtained judgment result indicates that a count of 20 is reached by the purge increase permission counter, the flow proceeds to step 216 and the purge ratio epgr is set as the resumption purge ratio. In step 216, the resumption purge ratio is set to 7/8 epgrold that is the purge ratio set immediately before a fuel cut. When the obtained judgment result indicates that a count of 20 is reached by the purge increase permission counter, the purge increase is permitted (step 214), and the purge ratio epgr is increased from the resumption purge ratio toward the target purge ratio for updating purposes (step 218).

When the density learning coefficient efgpg is smaller than judgment value G3, step 222 is performed to judge whether a count of 20 is reached by the purge increase permission counter. Before the obtained judgment result indicates that a count of 20 is reached by the purge increase permission counter, the flow proceeds to step 226 and the purge ratio epgr is set as the resumption purge ratio. In step 216, the resumption purge ratio is set to epgrold that is the purge ratio set immediately before a fuel cut. When the obtained judgment result indicates that a count of 20 is reached by the purge increase permission counter, the purge increase is permitted (step 224), and the purge ratio epgr is increased from the resumption purge ratio toward the target purge ratio for updating purposes (step 228).

Figure 17:
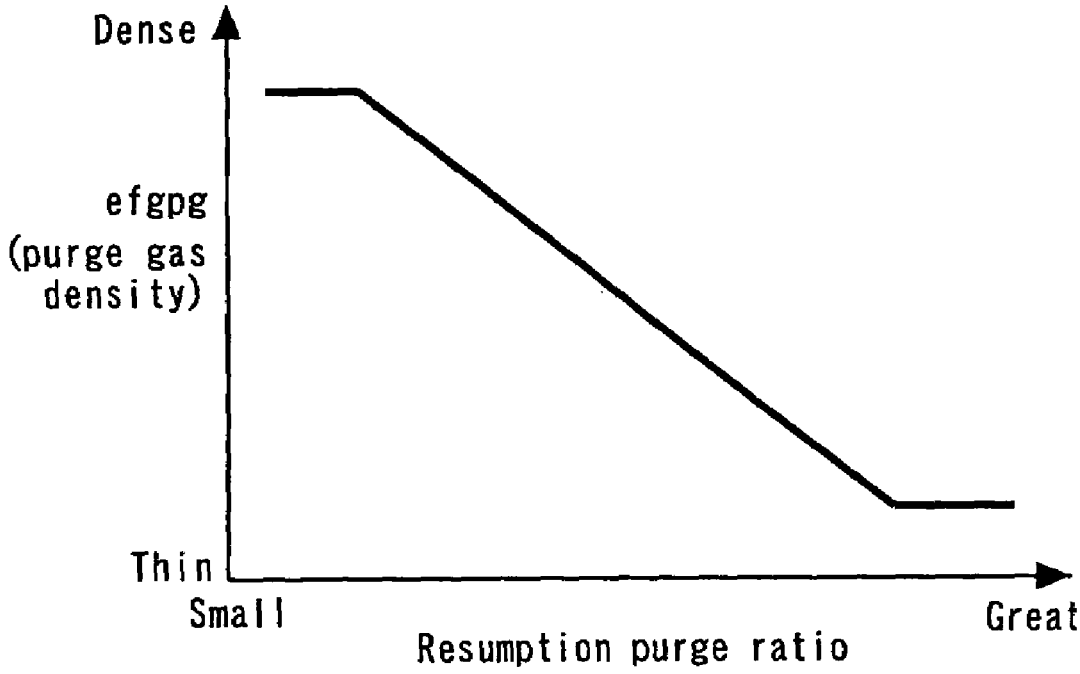
FIG. 17 is a map used in the routine shown in FIG. 16.

As indicated in FIG. 17, the purge control routine described above ensures that the resumption purge ratio increases with a decrease in the density learning coefficient efgpg, that is, increases with a decrease in the purge gas density. The influence of purge gas supply upon the air-fuel ratio decreases with a decrease in the purge gas density. Therefore, even if the purge ratio epgr is set to a great value immediately after a fuel cut while the purge gas density is low, an air-fuel ratio discrepancy is not likely to arise. The purge control routine described above causes the resumption purge ratio setting to increase with a decrease with a decrease in the density learning coefficient efgpg, that is, increase with a decrease in the purge gas density, thereby making it possible to adequately purge the evaporative fuel from the canister 40 without detriment to drivability.

Figure 18:
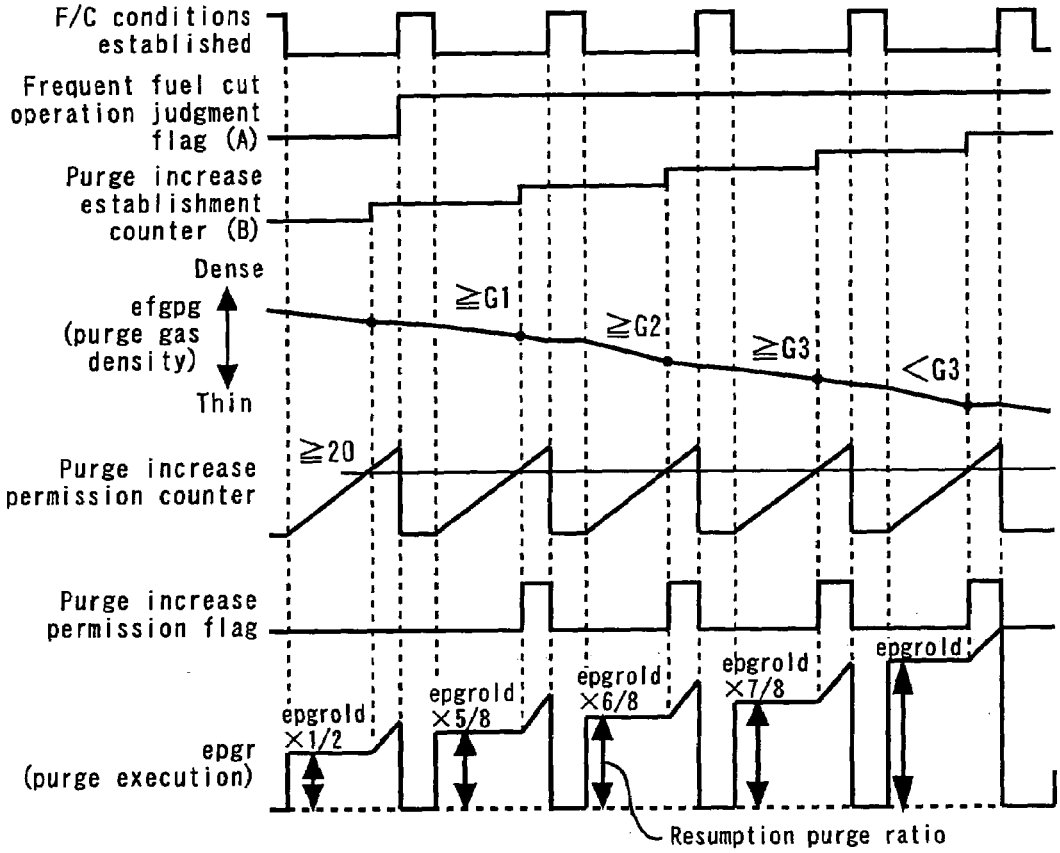
FIG. 18 is a timing diagram illustrating an example of the operation realized by the routine shown in FIG. 16.

FIG. 18 is a timing diagram illustrating a typical operation that is performed by the purge control routine described above. From top to bottom, the timing diagram indications, which change with time, are fuel cut ON/OFF, frequent fuel cut operation judgment flag A ON/OFF, purge increase establishment counter B, density learning coefficient efgpg, purge increase permission counter, purge increase permission ON/OFF, and purge ratio epgr. When the evaporative fuel is considerably purged out of the canister 40 so that the density learning coefficient efgpg gradually decreases with a decrease in the purge gas density, the resumption purge ratio setting prevailing after recovery from a fuel cut increases with a decrease in the density learning coefficient efgpg as indicated in FIG. 18. As a result, the amount of purge gas to be purged immediately after recovery from a fuel cut increases with a decrease in the density learning coefficient efgpg.

Others

While the present invention has been described in terms of preferred embodiments, it should be understood that the invention is not limited to those preferred embodiments, and that variations may be made without departure from the scope and spirit of the invention. For example, the following modifications may be made to the preferred embodiments of the present invention.

When the frequent fuel cut operation judgment flag A is established, the first embodiment provides a purge resumption period that is longer than normal. However, as described in conjunction with the fourth embodiment, a resumption purge ratio that is greater than normal may be alternatively employed without changing the purge resumption period. Another alternative is to shorten the purge resumption period and increase the resumption purge ratio setting.

The second embodiment causes the purge resumption period to decrease with an increase in the count reached by the purge increase establishment counter B. However, as described in conjunction with the fourth embodiment, the resumption purge ratio may alternatively be increased with an increase in the count reached by the purge increase establishment counter B. Another alternative is to shorten the purge resumption period and increase the resumption purge ratio when the count reached by the purge increase establishment counter B increases.

The third embodiment causes the purge resumption period to decrease with a decrease in the density learning coefficient efgpg. However, an alternative is to increase the resumption purge ratio while shortening the purge resumption period.

The major benefits of the present invention described above are summarized follows:

When it is judged that the driver operates the internal combustion engine by the special operation method, a first aspect of the present invention provides a shorter purge resumption period subsequent to recovery from a fuel cut than in a normal state. Therefore, the purge gas flow rate for a steady operation is provided earlier. If the purge gas flow rate is raised when the purge gas density is not properly learned after recovery from a fuel cut, the air-fuel ratio may become overrich, thereby allowing the acceleration to vary. However, the special operation method is adopted when the driver frequently operates the accelerator pedal by intention. Therefore, the driver does not feel uncomfortable even when the acceleration varies to a certain extent. In other words, the first aspect of the present invention reduces the purge resumption period only when a fuel cut is performed frequently in accordance with accelerator pedal operation. Thus, the first aspect of the present invention makes it possible to fully perform an evaporative fuel purge without detriment to drivability.

The higher the frequency with which the purge gas density is learned, the higher the learning accuracy of the associated learned value and the smaller the air-fuel ratio discrepancy resulting from purge gas supply after recovery from a fuel cut. A second aspect of the present invention ensures that the purge resumption period decreases with an increase in the frequency with which the purge gas density is learned. Thus, the second aspect of the present invention makes it possible to provide a purge gas flow rate for a steady operation at an earlier stage and perform an evaporative fuel purge to a greater extent.

The lower the purge gas density, the smaller the influence of purge gas supply on the air-fuel ratio. A third aspect of the present invention ensures that the purge resumption period decreases with a decrease in the purge gas density, thereby making it possible to provide a purge gas flow rate for a steady operation at an earlier stage and perform an evaporative fuel purge to a greater extent.

If the purge gas density learned after recovery from a fuel cut is significantly different from the purge gas density learned before the fuel cut, it can be judged that the purge gas density is still not accurately learned after recovery. If the difference between the purge gas density learned before a fuel cut and the purge gas density learned after the fuel cut is outside a predetermined range, a fourth aspect of the present invention prohibits the purge resumption period from being changed even when the special operation method is employed. Thus, the fourth aspect of the present invention avoids significant air-fuel ratio discrepancy, which may occur if the purge gas flow rate increases when the learning accuracy is insufficient.

When it is judged that the driver operates the internal combustion engine by the special operation method, a fifth aspect of the present invention provides a higher purge flow rate setting for the purge resumption period subsequent to recovery from a fuel cut than in a normal state. If the purge gas flow rate is raised when the purge gas density is not properly learned after recovery from a fuel cut, the air-fuel ratio may become overrich, thereby allowing the acceleration to vary. However, the special operation method is adopted when the driver frequently operates the accelerator pedal by intention. Therefore, the driver does not feel uncomfortable even when the acceleration varies to a certain extent. In other words, the fifth aspect of the present invention provides a high purge gas flow rate setting for the purge resumption period only when a fuel cut is performed frequently in accordance with accelerator pedal operation. Thus, the fifth aspect of the present invention makes it possible to fully perform an evaporative fuel purge without detriment to drivability.

The higher the frequency with which the purge gas density is learned, the higher the learning accuracy of the associated learned value and the smaller the air-fuel ratio discrepancy resulting from purge gas supply after recovery from a fuel cut. A sixth aspect of the present invention ensures that the purge gas flow rate setting for the purge resumption period increases with an increase in the frequency with which the purge gas density is learned. Thus, the sixth aspect of the present invention makes it possible to perform an evaporative fuel purge to a greater extent.

The lower the purge gas density, the smaller the influence of purge gas supply on the air-fuel ratio. A seventh aspect of the present invention ensures that the purge gas flow rate setting for the purge resumption period increases with a decrease in the purge gas density, thereby making it possible to perform an evaporative fuel purge to a greater extent.

If a fuel cut is continuously performed for a long period of time, the purge gas density prevailing after recovery from the fuel cut may be higher than the purge gas density prevailing before the fuel cut due to the influence of evaporative fuel generated during the fuel cut. When the duration of fuel cut time exceeds a predetermined period of time, a eighth aspect of the present invention judges that the operation performed by the special operation method is terminated, and then exercises control by a normal operation method. Thus, the eighth aspect of the present invention makes it possible to avoid significant air-fuel ratio discrepancy, which may occur when a large amount of high-density purge gas is supplied after recovery from a fuel cut.

The invention claimed is:

1. An evaporative fuel processing device for an internal combustion engine comprising:

a purge unit for supplying a purge gas, which contains evaporative fuel generated within a fuel tank, to an internal combustion engine's intake path;

an air-fuel ratio feedback control unit for learning purge gas density from the difference between exhaust air-fuel ratio and target air-fuel ratio, which prevails during an operation of the purge unit, and controlling the amount of fuel injection in accordance with the learned purge gas density;

a purge control unit for controlling the operation of the purge unit so that a purge gas flow rate matches the operating state of the internal combustion engine, stopping the operation of the purge unit when a fuel cut is performed, and providing a lower purge gas flow rate setting during a predetermined purge resumption period subsequent to recovery from a fuel cut than during a steady operation period; and a judgment unit for judging whether the internal combustion engine is operated by a special operation method in which a fuel cut is performed more frequently than predefined depending on the operation of an accelerator pedal;

wherein the purge control unit provides a shorter purge resumption period subsequently to recovery from a fuel cut when the judgment unit judges that the internal combustion engine is operated by the special operation method than when the judgment unit judges that the internal combustion engine is not operated by the special operation method.

2. An evaporative fuel processing device for an internal combustion engine according to claim 1, wherein the purge control unit exercises control so that the purge resumption period subsequent to recovery from a fuel cut decreases with an increase in the frequency with which the air-fuel ratio feedback control unit learns purge gas density.

3. An evaporative fuel processing device for an internal combustion engine according to claim 1, herein the purge control unit exercises control so that the purge resumption period subsequent to recovery from a fuel cut decreases with a decrease in the purge gas density that is learned by the air-fuel ratio feedback control unit.

4. An evaporative fuel processing device for an internal combustion engine according to claim 1, wherein the purge control unit calculates the difference between the purge gas density that is learned by the air-fuel ratio feedback control unit before a fuel cut and the purge gas density that is learned after recovery from the fuel cut, and when the density difference is outside a predetermined range, prohibits the purge resumption period from being changed.

5. An evaporative fuel processing device for an internal combustion engine according to claim 1 wherein, when the duration of fuel cut time exceeds a predetermined period of time, the judgment unit judges that the operation performed by the special operation method is terminated.

6. An evaporative fuel processing device for an internal combustion engine comprising:

a purge unit for supplying a purge gas, which contains evaporative fuel generated within a fuel tank, to an internal combustion engine's intake path;

an air-fuel ratio feedback control unit for learning purge gas density from the difference between exhaust air-fuel ratio and target air-fuel ratio, which prevails during an operation of the purge unit, and controlling the amount of fuel injection in accordance with the learned purge gas density;

a purge control unit for controlling the operation of the purge unit so that a purge gas flow rate matches the operating state of the internal combustion engine, stopping the operation of the purge unit when a fuel cut is performed, and providing a lower purge gas flow rate setting during a predetermined purge resumption period subsequent to recovery from a fuel cut than during a steady operation period; and a judgment unit for judging whether the internal combustion engine is operated by a special operation method in which a fuel cut is performed more frequently than predefined depending on the operation of an accelerator pedal;

wherein the purge control unit provides a higher purge gas flow rate setting for the purge resumption period subsequent to recovery from a fuel cut when the judgment unit judges that the internal combustion engine is operated by the special operation method than when the judgment unit judges that the internal combustion engine is not operated by the special operation method.

7. An evaporative fuel processing device for an internal combustion engine according to claim 6, wherein the purge control unit exercises control so that the purge gas flow rate setting for the purge resumption period subsequent to recovery from a fuel cut increases with an increase in the frequency with which the air-fuel ratio feedback control unit learns purge gas density.

8. An evaporative fuel processing device for an internal combustion engine according to claim 6, wherein the purge control unit exercises control so that the purge gas flow rate setting for the purge resumption period subsequent to recovery from a fuel cut increases with a decrease in the purge gas density that is learned by the air-fuel ratio feedback control unit.

9. An evaporative fuel processing device for an internal combustion engine according to claim 6 wherein, when the duration of fuel cut time exceeds a predetermined period of time, the judgment unit judges that the operation performed by the special operation method is terminated.

* * * * *